US007231055B2

(12) United States Patent
Uvacek et al.

(10) Patent No.: US 7,231,055 B2
(45) **Date of Patent: *Jun. 12, 2007**

(54) METHOD FOR THE ADJUSTMENT OF A HEARING DEVICE, APPARATUS TO DO IT AND A HEARING DEVICE

(75) Inventors: Bohumir Uvacek, Herrliberg (CH); Herbert Bachler, Meilen (CH)

(73) Assignee: Phonak AG, Stafa (CH)

( * ) Notice: Subject to any disclaimer, the term of this patent is extended or adjusted under 35 U.S.C. 154(b) by 767 days.

This patent is subject to a terminal disclaimer.

(21) Appl. No.: 09/999,676

(22) Filed: Oct. 24, 2001

(65) Prior Publication Data

US 2002/0051549 A1 May 2, 2002

Related U.S. Application Data

(63) Continuation of application No. 08/640,635, filed on May 1, 1996, now Pat. No. 6,327,366.

(51) Int. Cl.
*H04R 25/00* (2006.01)

(52) U.S. Cl. ..... 381/312; 381/60; 381/323; 381/314

(58) Field of Classification Search ..... 381/312, 381/314, 60, 323

See application file for complete search history.

(56) References Cited

U.S. PATENT DOCUMENTS 4,471,171 A 9/1984 Kopke et al.
4,489,610 A 12/1984 Slavin
5,274,711 A 12/1993 Rutledge et al.
5,303,306 A 4/1994 Brillhart et al.
5,396,560 A 3/1995 Arcos et al.
5,721,783 A * 2/1998 Anderson ..... 381/328
6,072,885 A * 6/2000 Stockham et al. ..... 381/312
6,108,431 A 8/2000 Bachler
6,118,877 A * 9/2000 Lindemann et al. ..... 381/312
6,327,366 B1 * 12/2001 Uvacek et al. ..... 381/312

FOREIGN PATENT DOCUMENTS

EP 0252205 1/1988

(Continued)

OTHER PUBLICATIONS

Leijon A: "Hearing Aid Gain for Loudness-Density Normalization in Cochlear Hearing Losses With Impaired Frequency Resolution" Ear and Hearing, Williams and Wilkins, US, Bd. 12, Nr. 4, 1990, Seiten 242-250, XP000645617.

(Continued)

*Primary Examiner*—Brian T. Pendleton
(74) *Attorney, Agent, or Firm*—Pearne & Gordon LLP

(57) ABSTRACT

An adjustment method for a hearing device and an apparatus to do it are proposed, by which a model for the perception of a psycho-acoustic variable, especially of the loudness, is parametrized for a standard group of individuals ($L_N$) as well as for an individual ($L_I$). On grounds of model differences, especially in relation to their parametrization, the adjustment values are determined, whereas the signal transmission is planned or adjusted at a hearing device (HG) ex situ or is guided in situ, respectively.

18 Claims, 19 Drawing Sheets

FOREIGN PATENT DOCUMENTS

Figure 1:
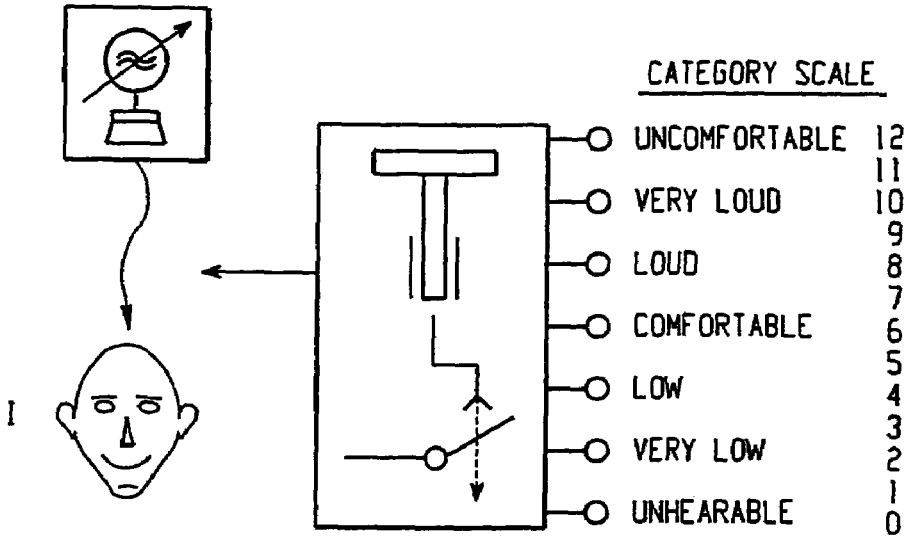

| | | | |
|---|---|---|---|
| EP | 0535425 | A2 | 4/1993 |
| EP | 0 579 152 | A | 1/1994 |
| EP | 0 581 262 | A | 12/1994 |
| GB | 2033641 | A | 5/1980 |
| GB | 2184629 | A | 6/1987 |
| WO | WO 90/08448 | | 7/1990 |
| WO | WO 90/09760 | | 9/1990 |

OTHER PUBLICATIONS

European Search Report For EP 95 10 3571.

* cited by examiner

METHOD FOR THE ADJUSTMENT OF A HEARING DEVICE, APPARATUS TO DO IT AND A HEARING DEVICE

This application is a continuation of U.S. application Ser. No. 08/640,635 filed May 1, 1996 now U.S. Pat. No. 6,327,366.

The present invention relates to a method for manufacturing a hearing device which is adapted to an individual.

Definitions

The term psycho-acoustic perception variable is used for a variable that is formed in a nonlinear manner by individual regularities of the perception, of physical-acoustic variables, such as frequency spectrum, sound pressure level, phase spectrum, signal course, etc.

In the past, known hearing devices modified physical, acoustic signal variables such that a hearing impaired individual could hear better with a hearing device. The adjustment of the hearing device is ensued by the adjustment of physical transfer variables, such as frequency-dependent amplification, magnitude limitation etc., until the individual is satisfied by the hearing device within the scope of the given possibilities.

Although it is known, for which reference is made to the mentioned publications, that the human acoustic perception follows complex psycho-acoustic individual valuations, these known phenomenon have not been used to optimize a hearing device until now.

Thereby, satisfying corrections with known hearing devices could mainly be obtained through taking the average over all known acoustic stimulus signals which occur in practice; mutual influence of acoustic stimulus signals could only be considered in an unsatisfying manner, if at all. Nonlinear phenomenon of psycho-acoustic perception, such as loudness and loudness summation, frequency and time masking, have not been considered.

It is an object of the present invention to provide a method, an apparatus and a hearing device, respectively, of the above-mentioned manner which allow to correct an individual, impaired, psycho-acoustic perception behavior relative to the respective standard, among which the statistical standard perception behavior of men is meant.

This will be obtained by a method of the above-mentioned manner by its implementation thereof by an apparatus of the above-mentioned manner.

Preferred embodiments of the method are as specified herein.

As will be seen, the apparatus for the adjustment of a hearing device according to the present invention can separately be realized from the hearing device. In addition, the apparatus according to the present invention also comprises means for the adjustment at the hearing device to correct the considered perception variables for the individual.

The apparatus which is defined in the claims, according to the present invention, the method according to the present invention and the hearing device according to the present invention, besides additional inventive aspects, will be explained in the following with reference to exemplified embodiments which are shown in drawings.

Figure 2:
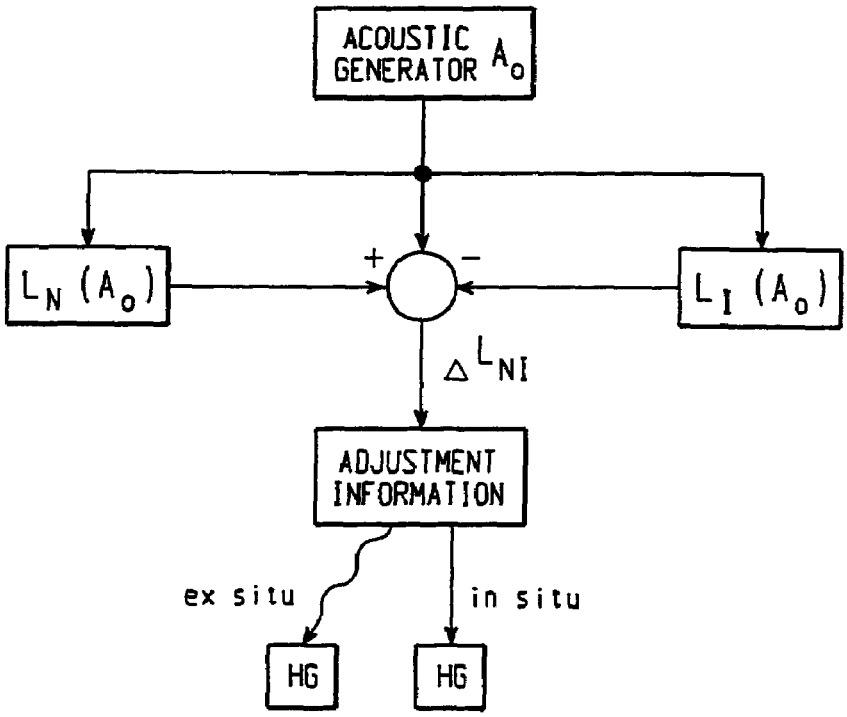
Figure 3:
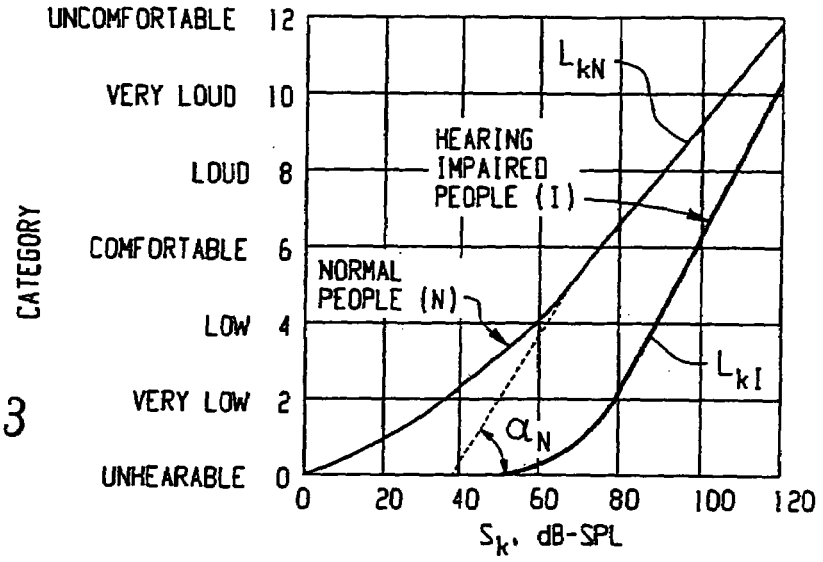
Figure 4:
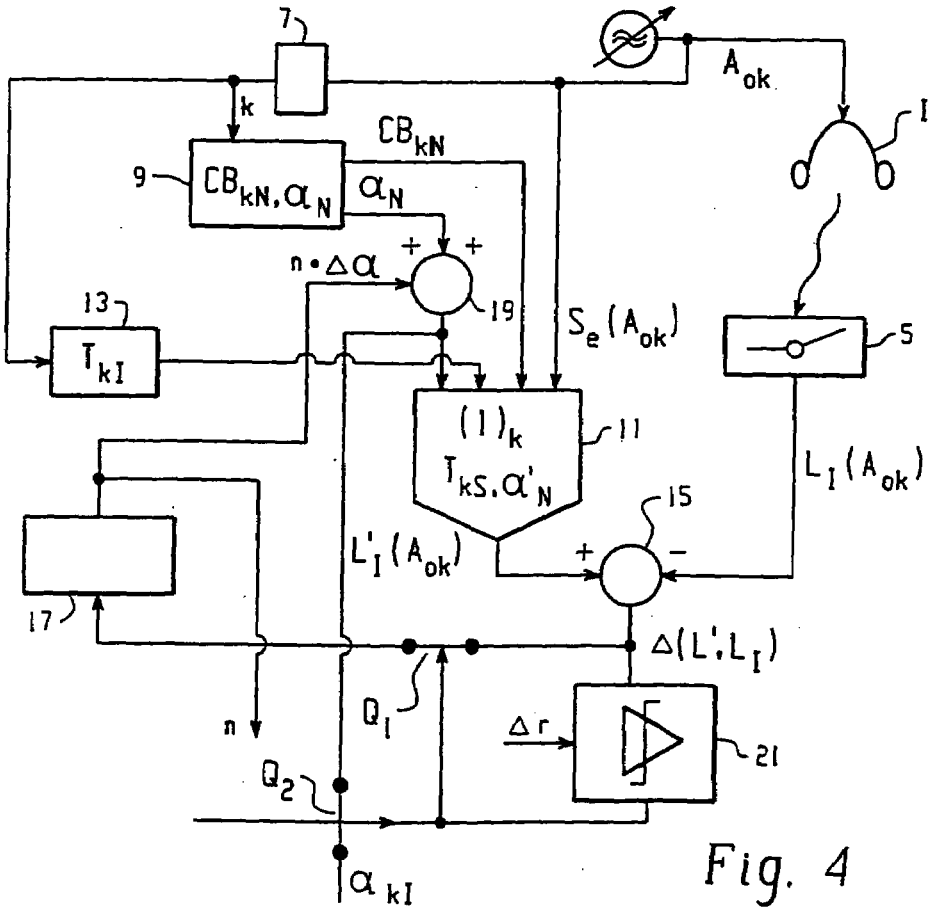
Figure 5:
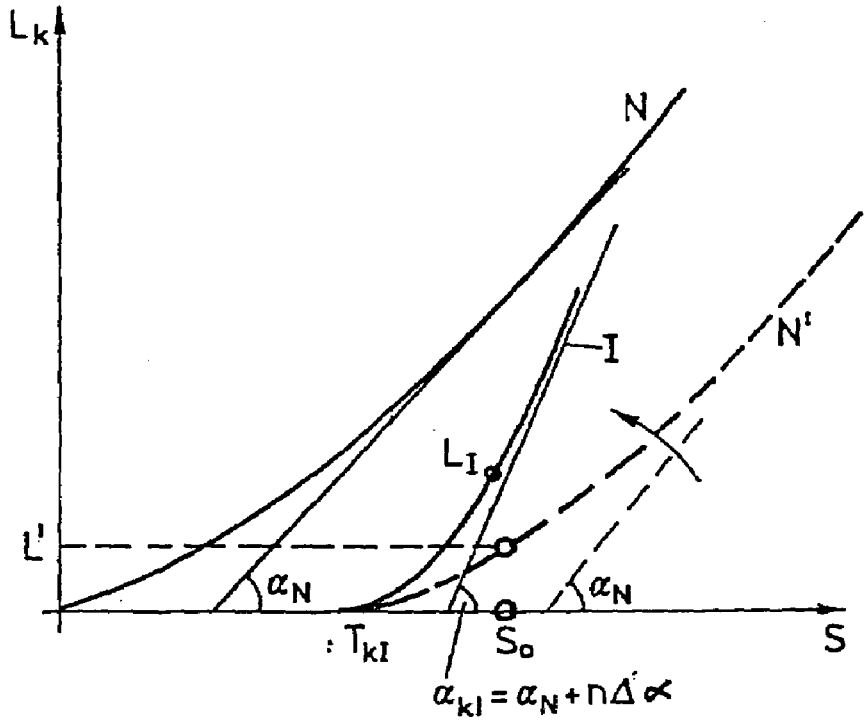
Figure 7:
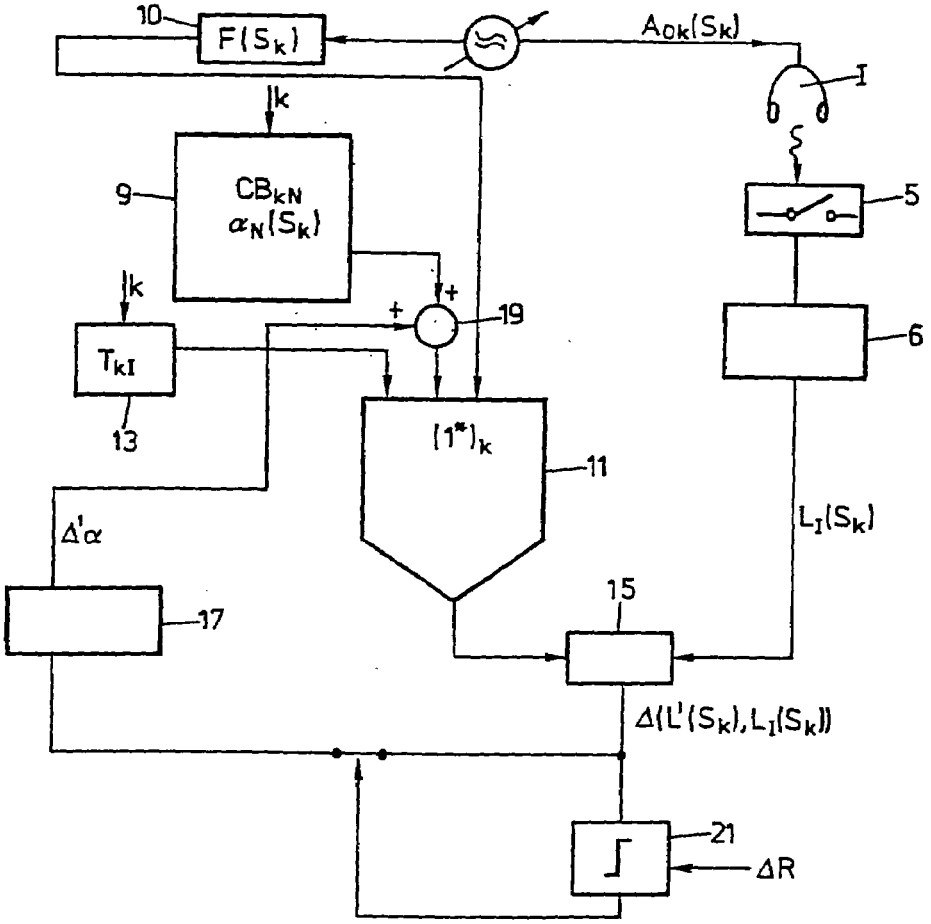
Figure 8:
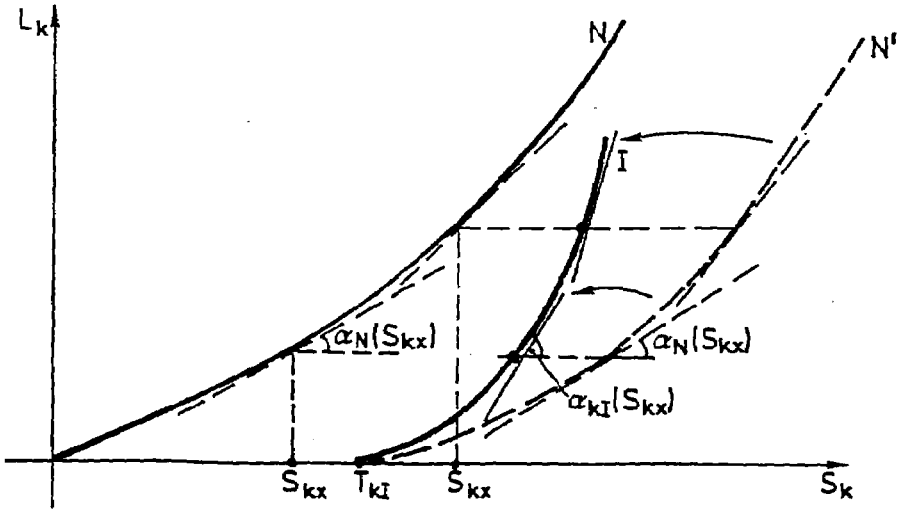
Figure 10:
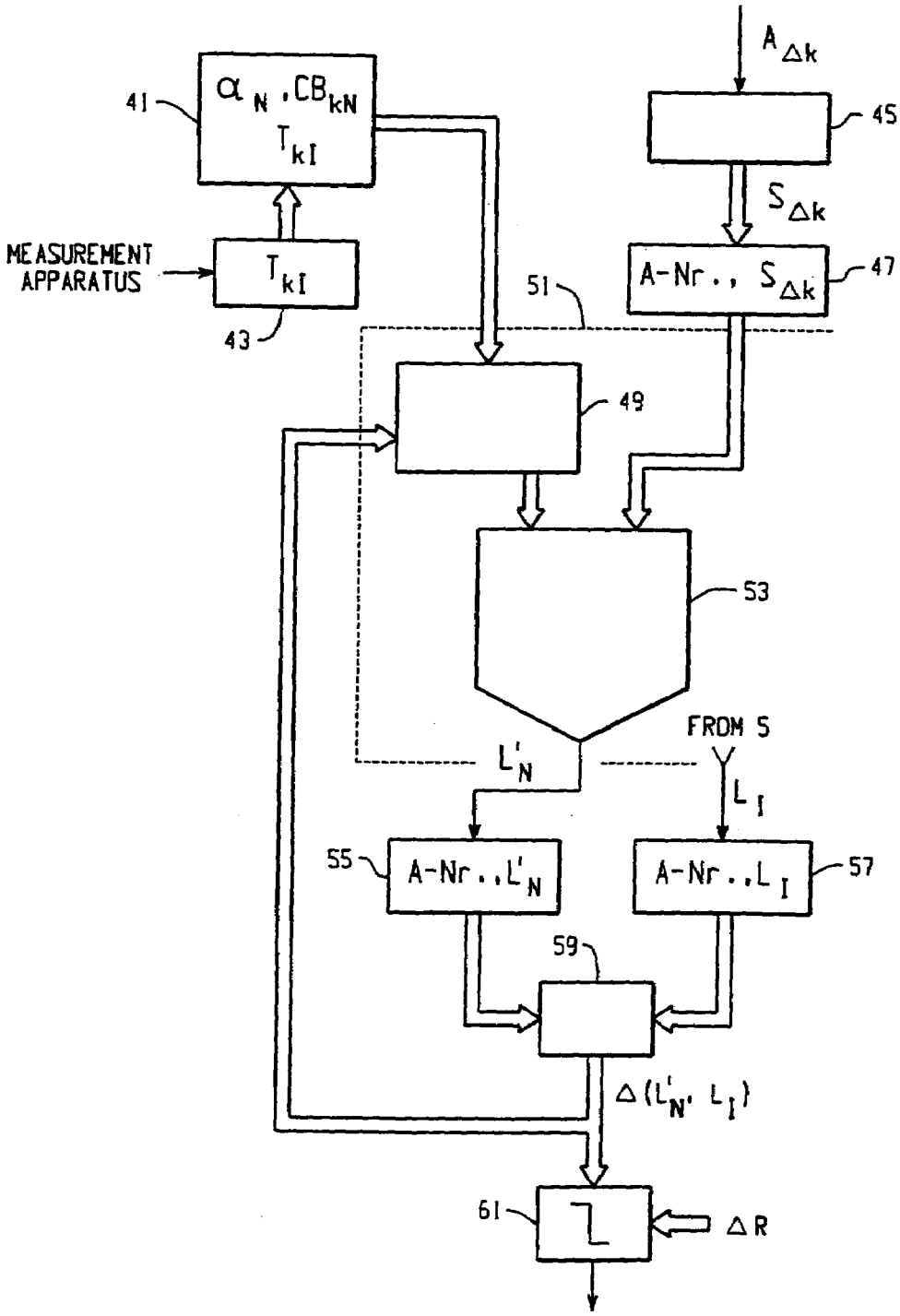
Figure 11:
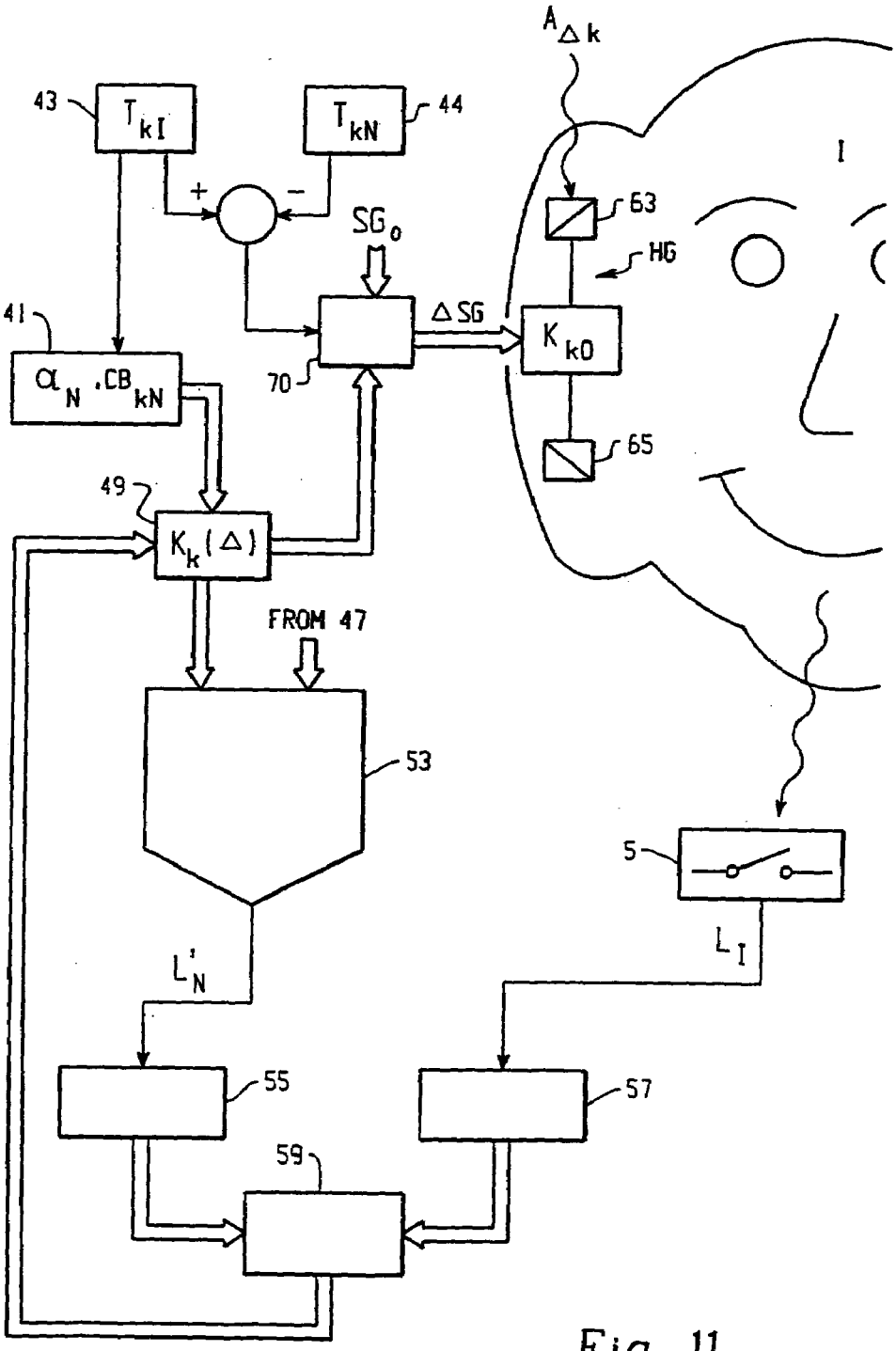
Figure 12A:
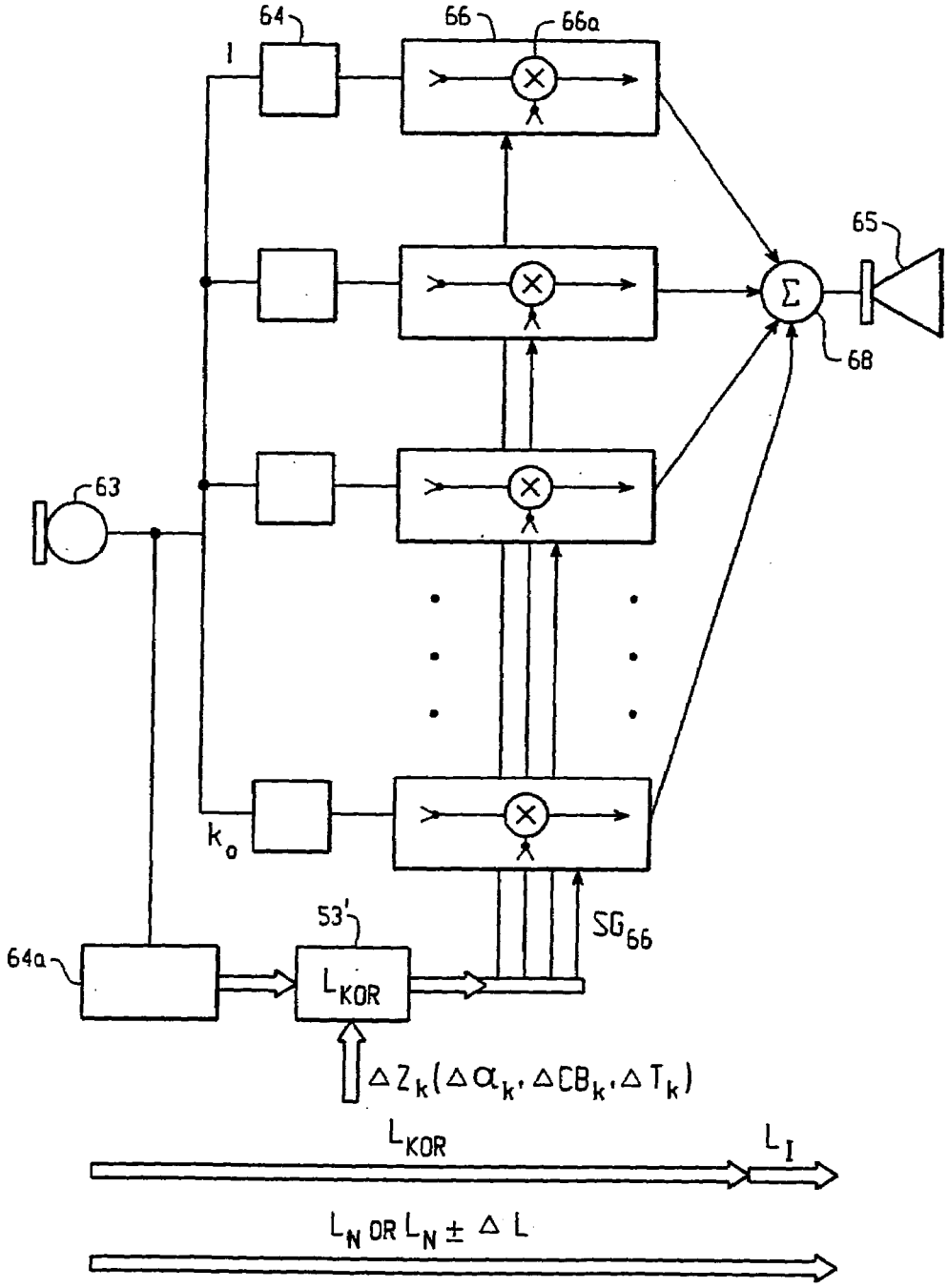
Figure 12B:
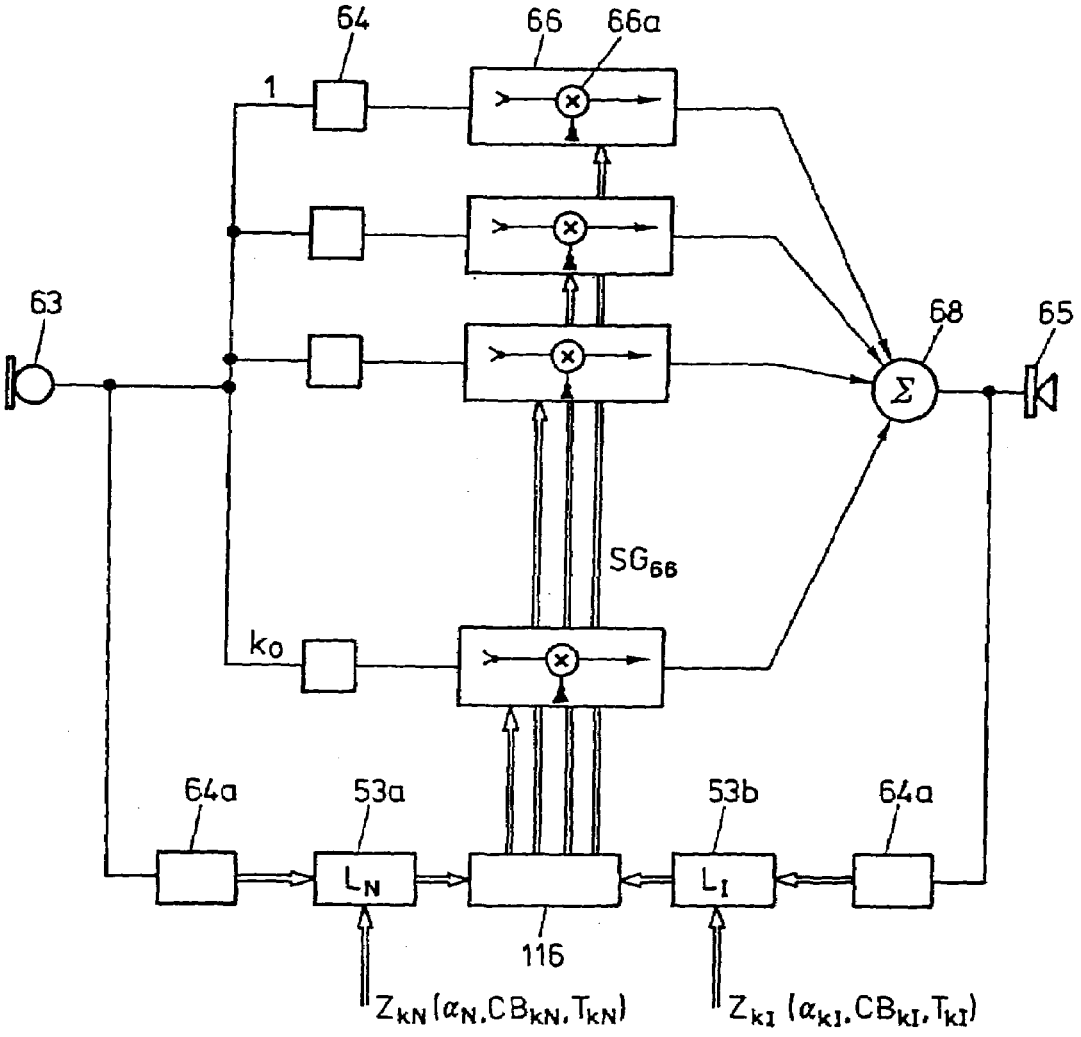
Figure 13:
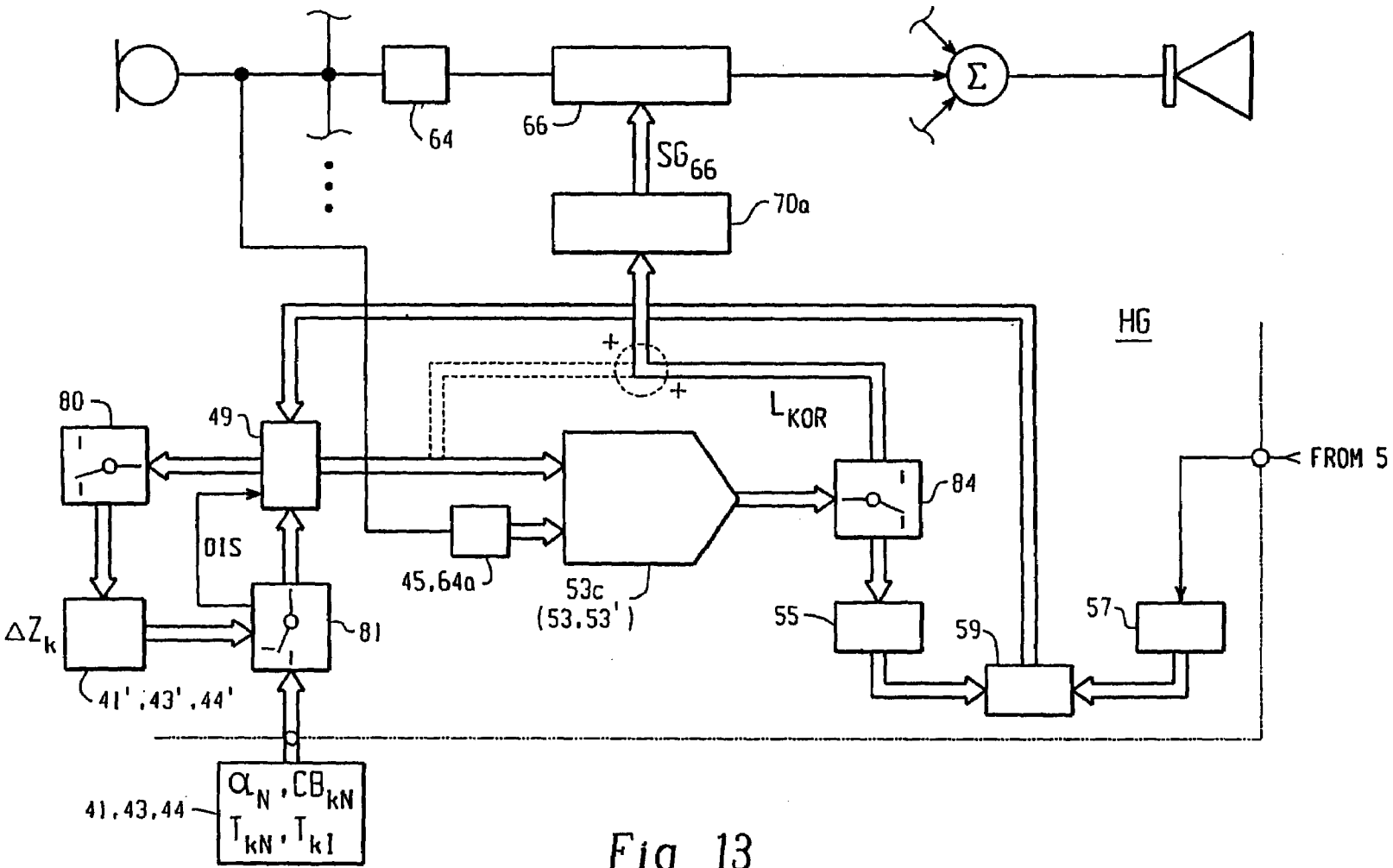
Figure 14:
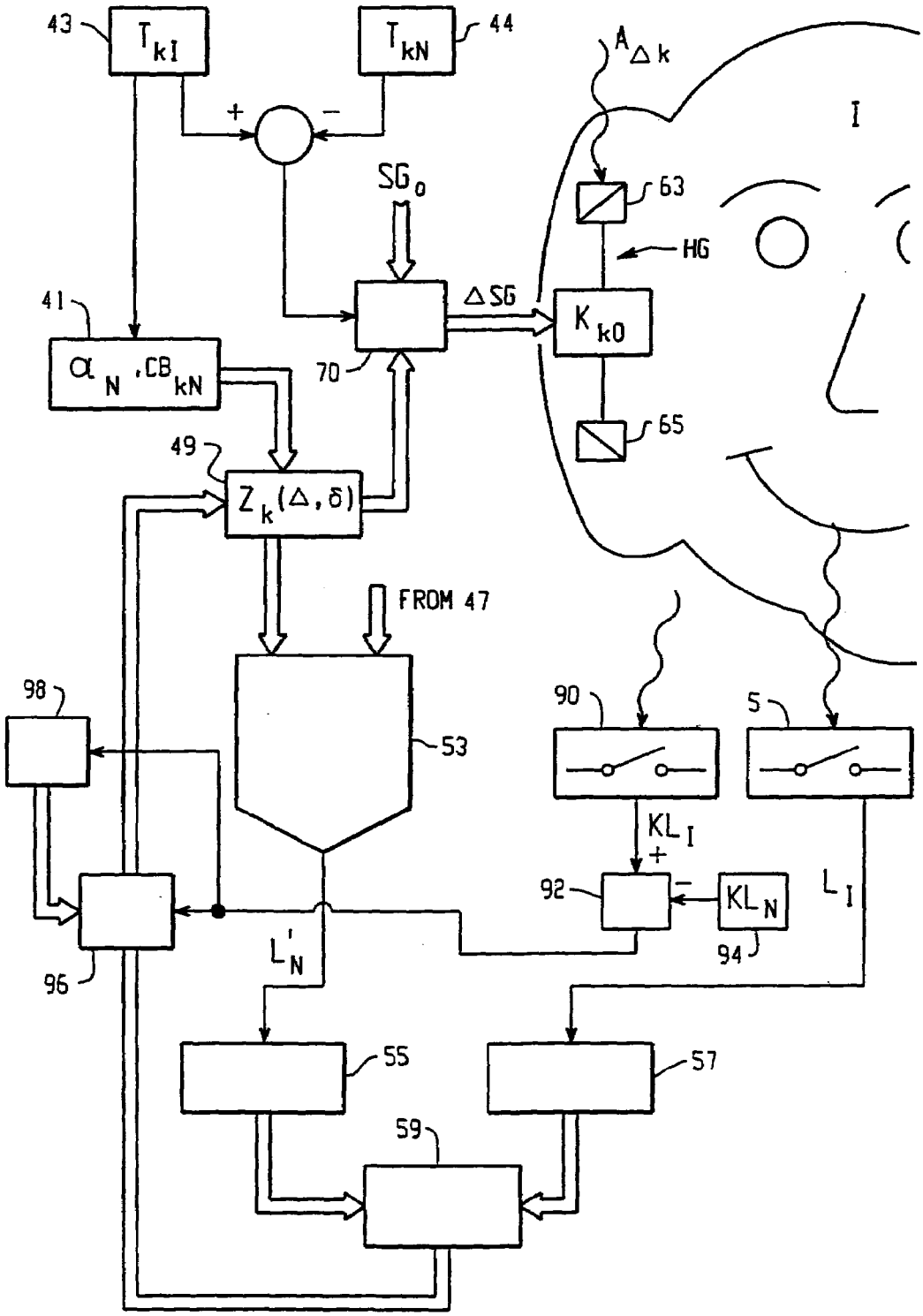
Figure 15:
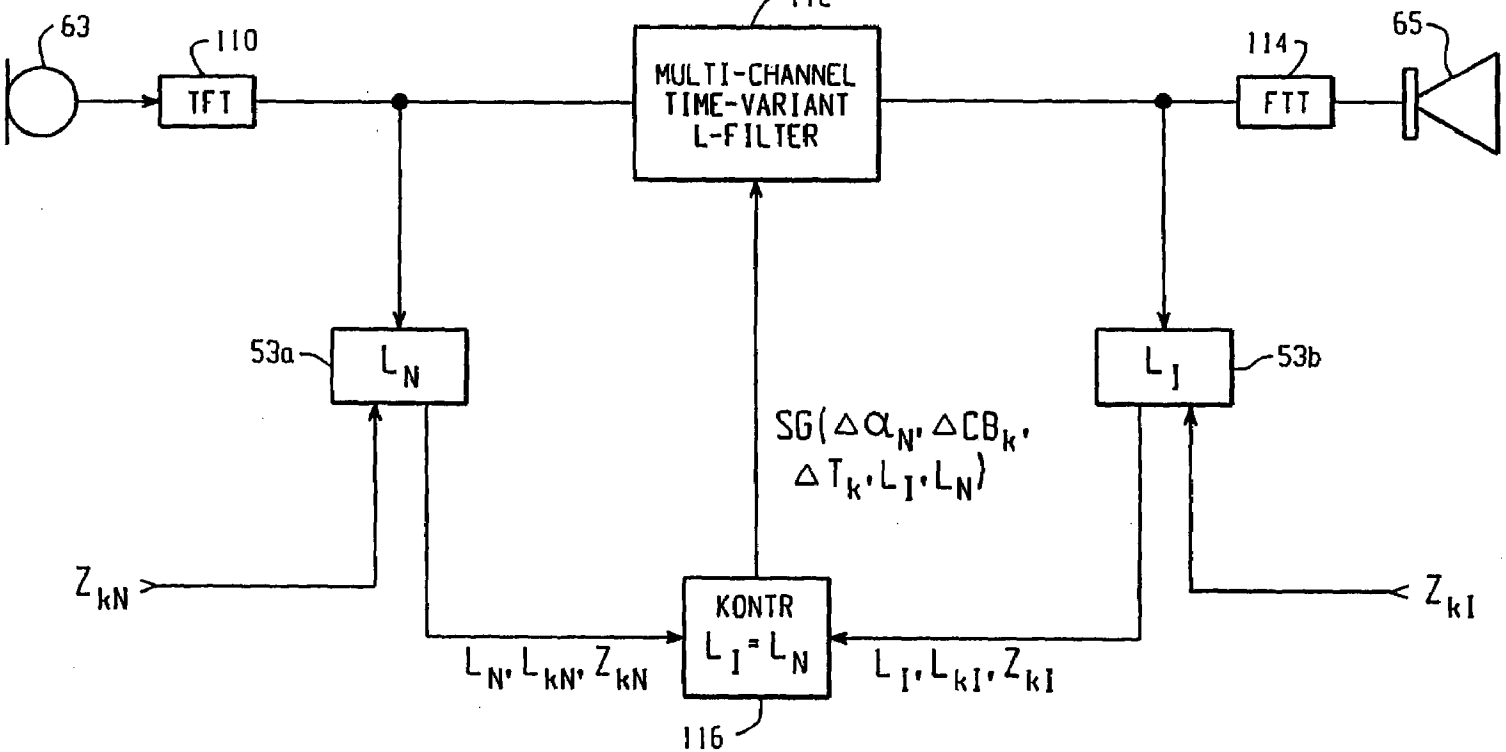
Figure 16:
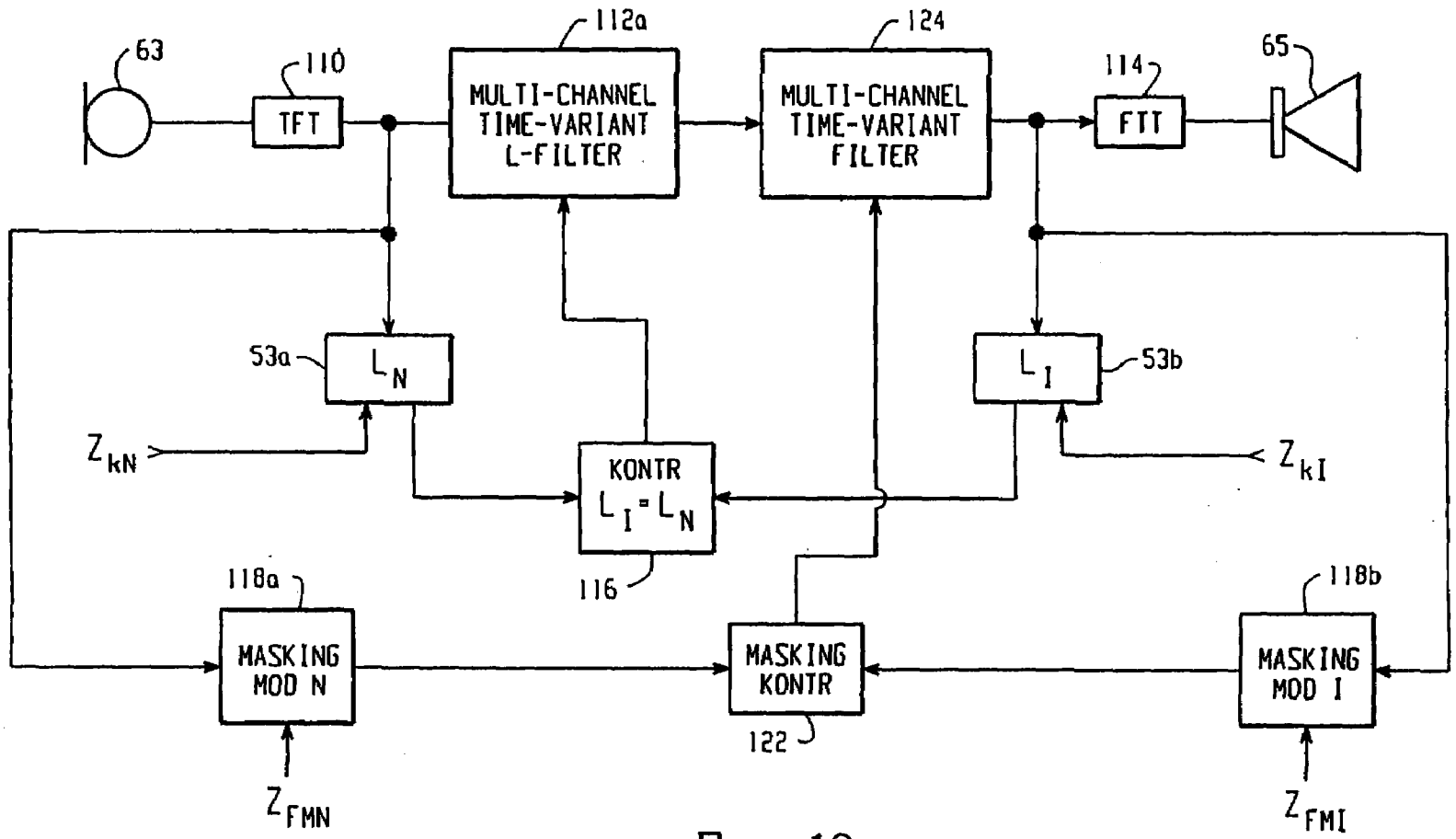
Figure 17:
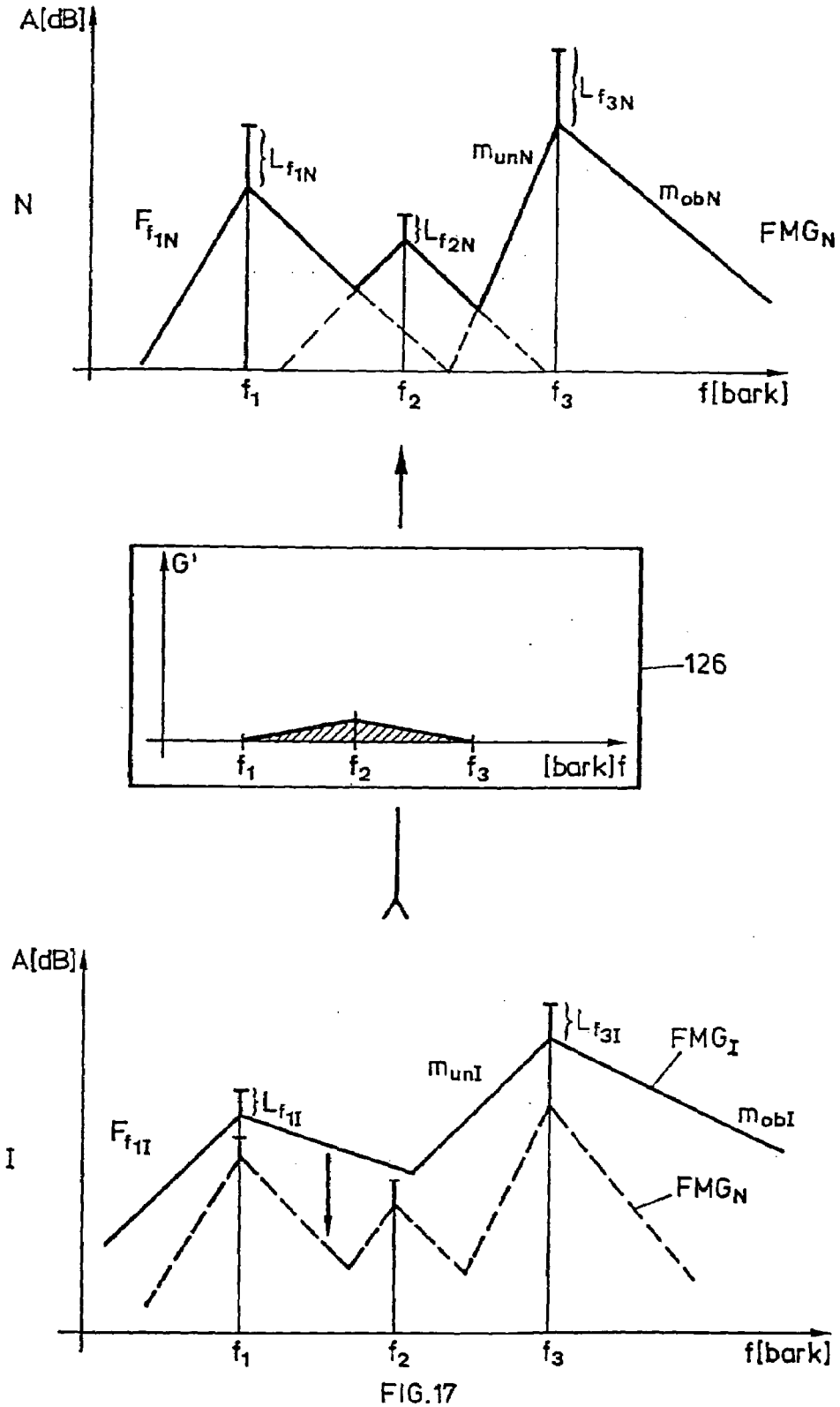
Figure 18:
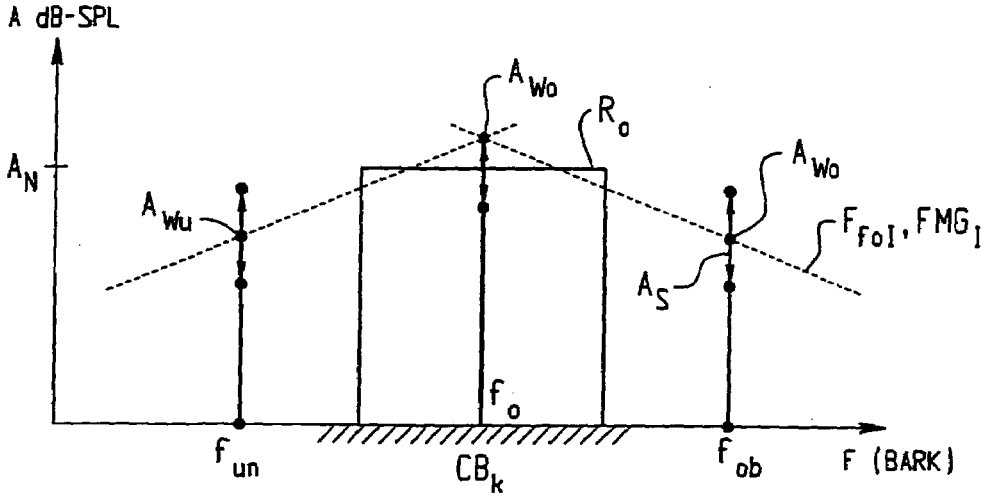
Figure 19:
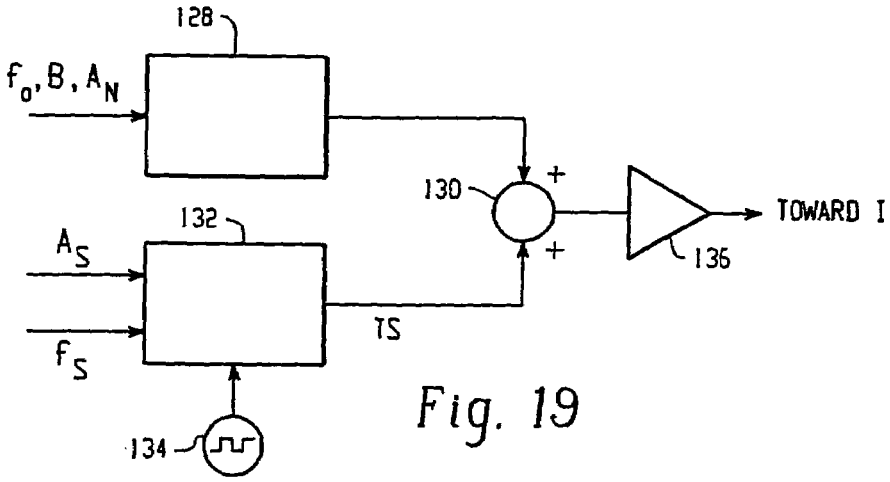
Figure 20:
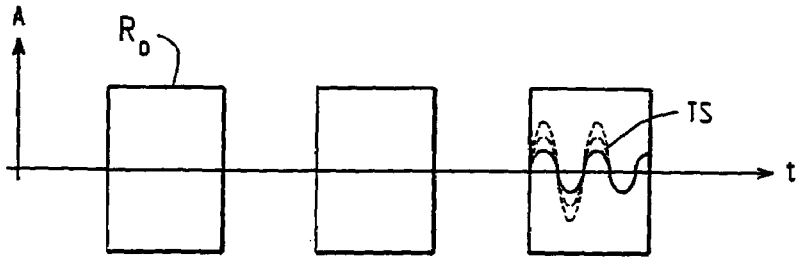
Figure 21:
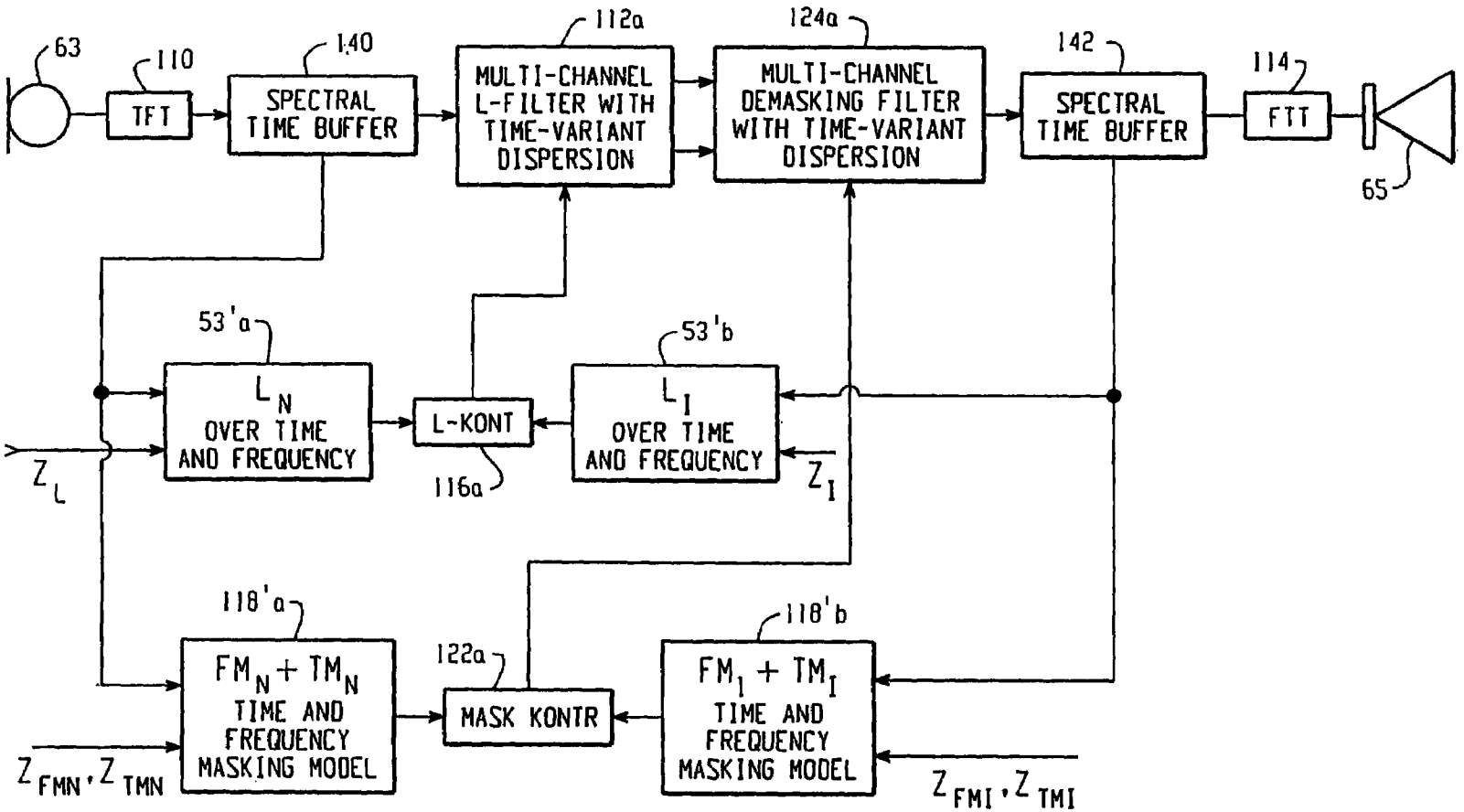
Figure 22:
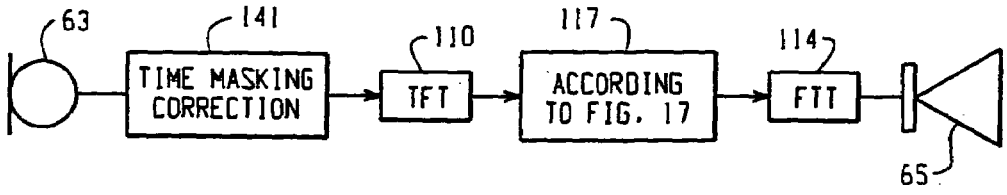
Figure 23:
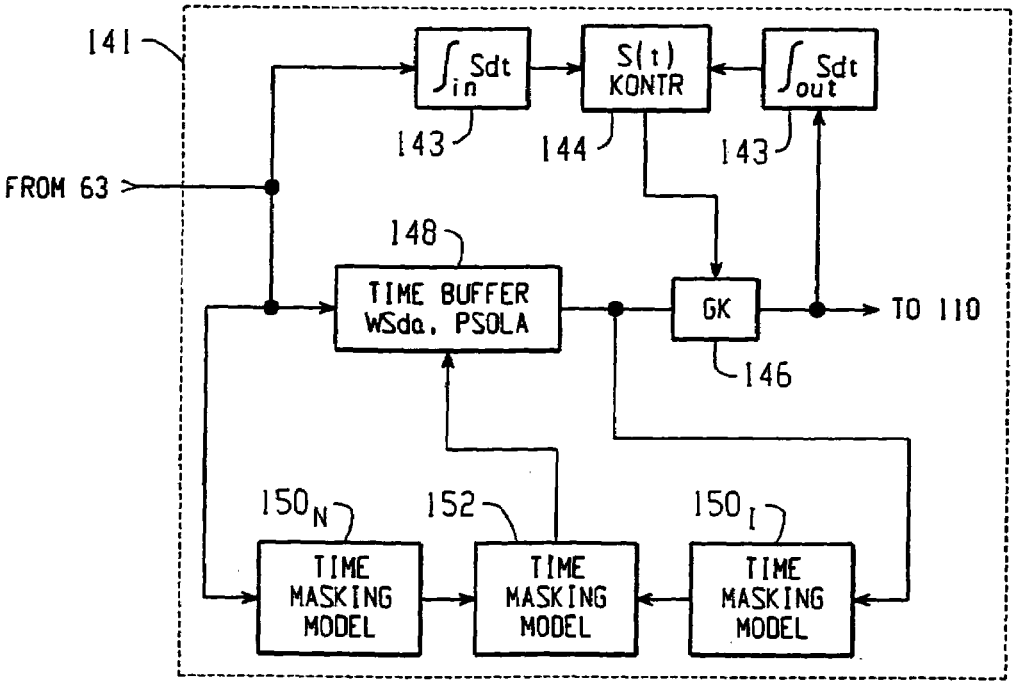
Figure 24:
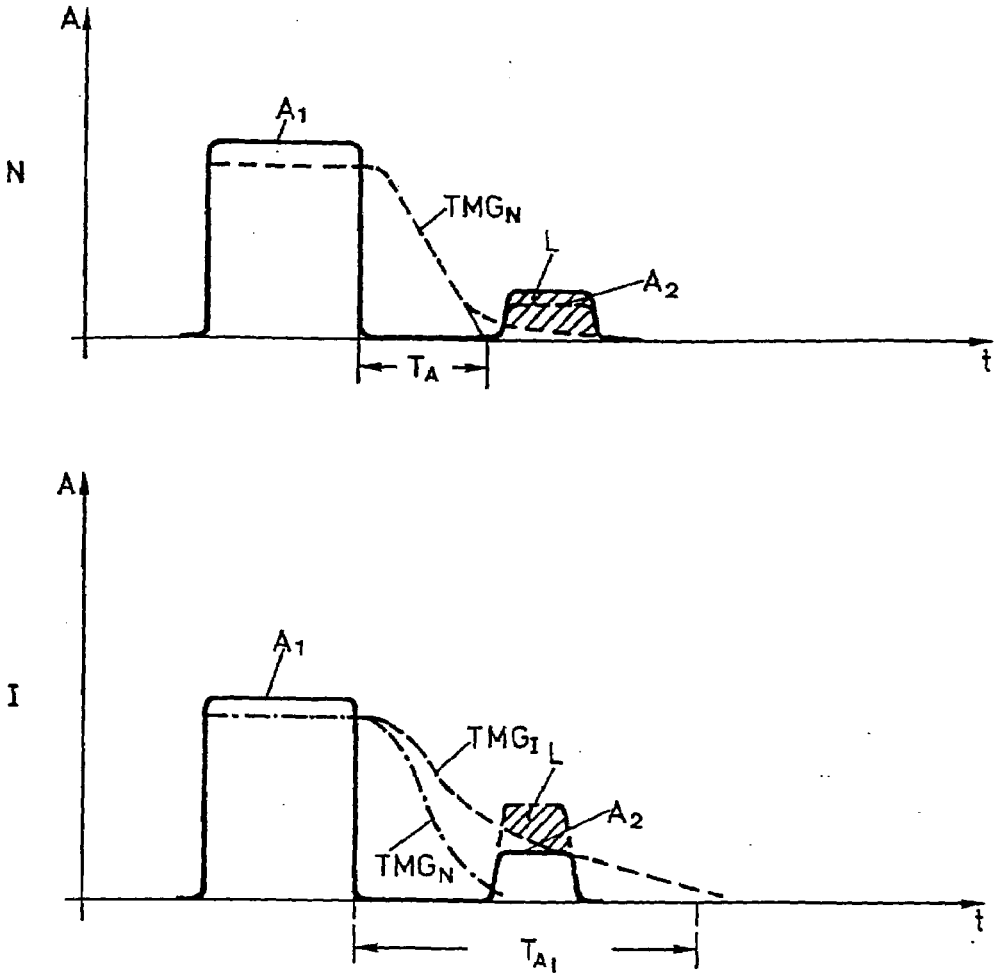
Figure 25:
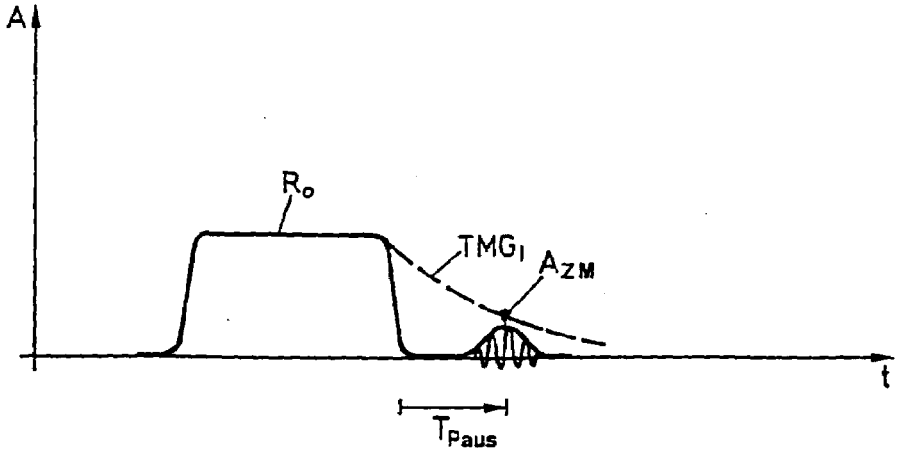

There is shown in:

FIG. 1 schematically, a quantifying unit for quantifying an individually perceived, psycho-acoustic perception variable;

FIG. 2 schematically, as block diagram, a basic proceeding according to the present invention;

FIG. 3 in function of the loudness level, the perceived loudness of a standard (N) and of a hearing impaired individual (I) in a critical frequency band k;

FIG. 4 as functional block-signal-flow-chart diagram, a first embodiment of an apparatus according to the present invention, functioning according to the inventive method, with which inventive adjustment variables for the transmission are determined for a hearing device;

FIG. 5 along with a representation similar to FIG. 3, a simplified diagram of the proceeding according to the present invention whereas the proceeding is realized according to FIG. 4;

FIG. 6*a* simplified, the proceeding according to FIG. 5;

FIG. 6*b* a simplified diagram of the resulting amplification course in a considered critical frequency band, which is to adjust at the transfer behavior of a hearing device according to the present invention, that is shown in FIG. 6*c* in its principle structure in relation to the transfer function;

FIG. 7 starting from the arrangement according to FIG. 4, a further developed arrangement for which the loudness model of FIG. 4 is further developed;

FIG. 8 on the analogy of FIG. 5, graphically simplified, the processing proceeding in the apparatus in accordance to FIG. 7;

FIG. 9 above the frequency axis, schematically, critical frequency bands of the standard and, by way of example, of an individual (a) with, for example, a resulting correction amplification function (b), sound-level- and frequency-dependent, for a hearing device transmission channel which corresponds to a considered critical frequency band;

FIG. 10 on the analogy of the representation of the apparatus according to FIG. 4, whereby the apparatus is further developed in consideration of critical frequency band sizes that have changed for the individual in respect to the standard;

FIG. 11 on the analogy of the representation of FIG. 10, an apparatus according to the present invention, that is used to adjust an inventive hearing device "in situ" in relation to its transmission behavior;

FIG. 12 *a*) and *b*) each as function-block-signal-flow-chart diagram, the structure of a inventive hearing device at which the transmission of a psycho-acoustic variable is adjusted in a correcting manner, in particular the loudness transmission;

FIG. 13 an embodiment of an inventive hearing device at which the precautions of the apparatus according to FIG. 11 and the one according to FIG. 12*a*) are implemented in combination at the hearing device;

FIG. 14 as example starting from the inventive apparatus according to FIG. 11 which is further developed taking also into consideration the sound perception of an individual;

FIG. 15 starting from the representation of an inventive hearing device according to FIG. 12*b*), a preferred embodiment by which the correction transmission of a psycho-acoustic perception variable, preferably the loudness, is processed in the frequency domain;

FIG. 16 starting from the representation of an inventive hearing device according to FIG. 15 which is further developed taking also into consideration a further psycho-acoustic perception variable, namely the frequency masking;

FIG. 17 schematically, the frequency masking behavior of the standard and of a heavily hearing impaired individual with a—resulting from these, qualitatively represented and realized—correction behavior in an inventive hearing device according to FIG. 16;

FIG. 18 along with a frequency/level characteristic, the procedure to determine the frequency masking behavior of an individual;

FIG. 19 as a function-block-signal-flow-chart diagram of a measurement arrangement to perform the determination procedure, as described along with FIG. 18;

FIG. 20 above the time axis, signals, which are presented to an individual, for the determination which has been described along with FIG. 18;

FIG. 21 starting from an inventive hearing device with a structure according to FIG. 15 or 16, which structure is further developed to also consider the time masking behavior as a further psycho-acoustic perception variable;

FIG. 22 the simplified block diagram of an inventive hearing device which, as the one represented in FIG. 21, considers the time-masking behavior as further psycho-acoustic perception variable but in a different embodiment;

FIG. 23 the time-masking correction unit which is contained in the inventive hearing device according to FIG. 22;

FIG. 24 schematically, the time-masking behavior of the standard and of an individual as example to describe correction measures which result from them to correct the time-masking behavior of an individual to the one of the standard by a hearing device according to the present invention;

FIG. 25 schematically, over the time axis, the signals which are presented to determine the time-masking behavior of an individual.

Psycho-acoustic Perception, in Particular Loudness and its Quantification

The loudness "L" is a psycho-acoustic variable, which defines how "loud" an individual perceives a presented acoustic signal.

The loudness has its own measurement unit ; a sinusoidal signal having a frequency of 1 kHz, at a sound pressure level of 40 dB-SPL, produces a loudness of 1 "Sone". A sine wave of the same frequency having a level of 50 dB-SPL will be perceived exactly double as loud; the corresponding loudness is therefore 2 Sones.

As with natural acoustic signals, which are always broadband, the loudness does not correspond to the physical transmitted energy of the signal. Psycho-acoustically, a valuation is performed of the received acoustic signal in the ear in single frequency bands, the so called critical bands. The loudness is obtained from a band-specific signal processing and a band-overlapping superposition of the band-specific processing results, known under the term "loudness summation". This basic knowledge has been fully described by E. Zwicker, "Psychoakustik", Springer-Verlag Berlin, Hochschultext, 1982.

Considering the loudness as one of the most substantial psycho-acoustic variables which determine the acoustic perception, the present invention has the object to propose a method and a useful apparatus for it, with which a hearing device that can be adjusted to an individual can be adjusted such that the acoustic perception of the individual corresponds, at least in a first-order approximation, to one of a standard, namely of a normal hearing person.

One possibility to seize the individually perceived loudness of selected acoustic signals as further processed variables at all, is the one schematically represented in FIG. 1, in particular the known method of O. Heller, "Hörfeldaudiometrie mit dem Verfahren der Kategorieunterteilung", Psychologische Beiträge 26, 1985, or of V. Hohmann, "Dynamikkompression für Hörgerate, Psychoakustische Grundlagen und Algorithmen", dissertation UNI Göttingen, VDI-Verlag, vol. 17, no. 93. Thereby, an acoustic signal A is presented to an individual I, which signal A can be altered in respect to its spectral composition and to its transferred sound pressure level S through a generator 1. The individual I evaluates or "categorizes", respectively, the momentary heard acoustic signal A by an input unit 3 according to, for example, thirteen loudness levels or loudness categories, respectively, as it is shown in FIG. 1, which levels are classified into numerical weights, for example from 0 to 12.

Through this proceeding, it is possible to measure the perceived individual loudness, i.e. to quantify, but only punctually in relation to given acoustic signals, whereas through such measurements, it is not possible to obtain the individually perceived loudness which is perceived for natural, broad-band signals.

If, in the following, the loudness is taken as the primary variable having impact on the psycho-acoustic perception, so only because this variable determines the psycho-acoustic perception of acoustic signals to a large extent. As will be explained subsequently, the proceedings according to the present invention can absolutely be used to consider further psycho-acoustic variables, in particular for the consideration of the variable "masking behavior in the time domain and/or in the frequency domain".

FIG. 2 shows, for the time being, schematically, the basic principle of the preferred inventive proceeding which is described in detail in the following.

Of the standard, N, a psycho-acoustic perception variable is determined by standardized acoustic signals $A_o$, as for example the loudness $L_N$, and compared with the values of these variables, corresponding to $L_I$ Of an individual, of the same acoustic signals $A_o$. From the difference corresponding to $\Delta L_{NI}$, adjustment information are determined which directly have an impact on the hearing device or with which a hearing device is adjusted manually. The determination Of $L_I$ is ensued at the individual without a hearing device, or with a hearing device which is not yet adjusted to or, if need be, which is adjusted to subsequently.

The loudness itself is a variable which depends on further variables. For that reason, the number, on the one hand, of measurements which are performed at an individual is great to simply obtain sufficient information which is enough precise to perform the desired perception correction by the adjustment engagement at the hearing device for all broadband signals which occur in natural surroundings. On the other hand, the correlation of the obtained differences is not unique and very complex regarding the adjustment engagement at the transfer behavior of a hearing device.

With that, a reduction of measurements which are performed at the individual is striven for in a preferred manner for the time being and searched for a solution in such a way that it is possible to relatively easily conclude from measurement results performed at the individual and its comparison with standard results to the necessary adjustment engagements.

Basically, a quantifying model of the perception variable, in particular of the loudness, will therefore be used. In such a model, acoustic input signals of any kind shall be used; the respective searched output variable at least results as approximation. On the other hand, the model, that is valid for the individual, should be identified with relatively few measurements. The identification should be interrupted, if the model is identified to an extend which has been previously set.

Such a quantifying model of a psycho-acoustic perception variable must not be defined by a closed mathematical statement, but can, by all means, be defined by a multi-dimensional table of which, according to the respective current frequency and sound level relations of a real acoustic signal as variable, the perceived perception variable can be recalled. Although different mathematical models can be thoroughly used for the loudness, it has been recognized according to the present invention that the model which is similar to the one used by Zwicker and which corresponds to the one used by A. Leijon, "Hearing Aid Gain for Loudness-Density Normalization in Cochlear Hearing Losses with Impaired frequency Resolution", Ear and Hearing, Vol. 12, Nr. 4, 1990, is best suitable to reach the set goal. It reads:

$$L = \sum_{k=1}^{k_0} \frac{1}{CB_k} \cdot 10^{\frac{\alpha_k \cdot T_k}{10}} \cdot \left\{ \left[ \frac{1}{2} \cdot CB_k \cdot 10^{\frac{S_k - T_k}{10}} + \frac{1}{2} \right]^{\alpha_k} - 1 \right\} \quad (1)$$

Whereas:

k: index with $1 \leqq k \leqq k_o$, numbering of the number $k_o$, of critical bands which are considered;

$CB_k$: spectral width of the considered critical band with the number k;

$\alpha_k$: slope of a linear approximation of loudness perception, which are scaled in categories, at logarithmic representation of the level of a presented sinusoidal or narrow-band acoustic signal having a frequency which approximately lies in the center of the considered critical band $CB_k$;

$T_k$: hearing limit for the mentioned sine wave signal;

$S_k$: the average sound pressure level of a presented acoustic signal at the considered critical frequency band $CB_k$.

As can be seen, the band specific, average sound pressure levels $S_k$ form the model variables which define a presented acoustic signal, which model variables define the current spectral power density distribution. The spectral width of the considered critical bands $CB_k$, the linear approximation of the loudness perception, $\alpha_k$, and the hearing limit $T_k$ are parameters of the model or of the mathematical simulation function according to (1).

Furthermore, it has been found that the parameters $\alpha_k$, $T_k$ and $CB_k$ of this model, on the one hand, can be easily obtained by relatively few tests at individuals, and that these coefficients are also relatively easily correlated with transfer variables of a hearing device, and, with that, they are adjustable through adjustment engagements at a hearing device for an individual.

The model parameters $\alpha_k$, $T_k$ and $CB_k$ have been determined using the standard N, i.e. for people having a normal hearing.

The linear approximation of the loudness into categories for each increase of the average sound pressure $S_k$ in dB in the corresponding critical bands $CB_N$ of the standard is described as equal in the publications, in particular in E. Zwicker, "Psychoakustik", for all critical bands of the standard.

FIG. 3 shows the loudness course, as course $L_{kN}$, of the standard in function of the sound levels $S_k$ of a presented acoustic signal which lies in a respective critical band k and which has been recorded as has been described along with FIG. 1. A sinusoidal signal or a band-limited noise signal with a narrow band are presented. As can be seen thereof, the parameter $\alpha_N$ represents the slope of a linear approximation or of a regression line, respectively, of this course $L_{kN}$ at higher sound levels, i.e. at sound pressure levels of 40 to 120 dB-SPL, at which also the acoustic signals can mostly be found. This will also be called as "large signal behavior" in the following. As mentioned, this slope can be assumed to be equal $\alpha_N$ at the standard.

A consideration of FIG. 3 in regard to the mathematical model according to (1) also shows that the non-consideration of the level dependence of the course slope of $L_{kN}$, i.e. the approximation of this course through a regression line, can only lead to a model of first-order approximation. The model will be more precise, if the parameter values, i.e. $\alpha_N = \alpha_N(S_k)$, are set in each critical band, sound-pressure-dependent, i.e. if in each band k $\alpha_{kN}(S_k)$ it set to $dL_{Nk}/dS_k$.

Compared to the parameter $\alpha_N$, the hearing limit $T_{kN}$ is also different for the standard and already in first-order approximation in each critical frequency-band $CB_{kN}$ and is not a priori identical to the 0 dB-sound pressure level.

The typical hearing limit course of the standard is exactly laid down in ISO R226 (1961).

In addition, the bandwidths of the critical bands $CB_{kN}$ are standardized for the standard and its number $k_o$ in ANSI, American National Standard Institute, American National Standard Methods for the Calculation of the Articulation Index, Draft WG p. 3.79, May 1992, V2.1.

With that, in summary, the preferred used mathematical loudness model according to (1) is known for the standard.

As can be certainly seen, large deviations can occur between the perceived loudness of individuals and the one of the statistically determined standard. In particular, a specific coefficient $\alpha_{KI}$ can be determined for each critical frequency band of individuals I, particularly of heavily hearing impaired individuals, which deviate from the standard; furthermore, deviations from the standard obviously arise in relation to the hearing limit $T_{kI}$ and the widths of the critical bands $CB_{kI}$.

Leijon has described a procedure which allows to estimate the additional coefficients or model parameter $\alpha_{kI}$, $CB_{kI}$, respectively, from the hearing limit $T_{kI}$ of individuals. However, the estimation errors are mostly large considering individual cases. Nevertheless, one can start, for the identification of individual loudness models, with estimated parameters which are, for example, estimated from diagnostic information. Through that, the necessary effort and, with it, also the burden of the individual decreases dramatically.

Determination of the Coefficients $\alpha_{kI}$, $CB_{kI}$, and $T_{kI}$ by Measurement As already mentioned, the loudness L, recorded by a categories scaling according to FIG. 1, is drawn in function of the average sound pressure level in dB-SPL for a sinusoidal or narrow-band signal of the frequency $f_k$ in a considered critical band of the number k. As has been already mentioned, the loudness $L_N$ of the standard in the chosen representation increases nonlinear with the signal level, the slope course is reproduced in a first-order approximation of a normal hearing person for all critical bands by the regression line with the slope $\alpha_N$ [categories per dB-SPL] which regression line is drawn in FIG. 3 as course N.

From this representation, it is obvious that the model parameter $\alpha_N$ corresponds to a nonlinear amplification, equal for normal hearing people in each critical band, but to determine for individuals, with $\alpha_{kI}$, in each frequency band. The nonlinear loudness function in the band k will be approximated by the line with the slope $\alpha_k$, i.e. by a regression line.

In FIG. 3, $L_{kI}$ typically identifies a course of a loudness $L_I$ of a hearing impaired person in a band k.

As can be seen from the comparisons of the graphs $L_{kN}$ and $L_{kI}$, the graph of a hearing impaired person shows a larger offset regarding to zero and takes a course which is steeper than the graph of the standard. The larger offset corresponds to a higher hearing level $T_{kI}$, the phenomenon of the basically steeper loudness graph is named as loudness-recruitment and corresponds to a higher $\alpha$-parameter.

It is known that hearing limits are basically to be determined by classic limit audiometry. After all, it is possible, also in the scope of the limit audiometry, to measure the hearing limit $T_{kI}$ of individuals with an arrangement according to FIG. 1 through limit detection between non-audible and audible. With that, larger errors must be put up in the surroundings of the limit value. In the following, the assumption is made that the considered hearing limits $T_{kI}$, through audiometry, have been already measured and are known.

Referring to the remaining model parameter according to (1), i.e. the width of the considered critical bands $CB_{kI}$, it can be said that the occurrence of several such bands will not come into effect before the psycho-acoustic processing of the broad-band audio signals, i.e. of the broad-band signals of which their spectrums lay in at least two neighboring critical bands. With hearing impaired people, a spreading of critical bands can be typically established, for that reason, also the loudness summation is primarily affected.

For the determination of the bandwidth of the critical bands, different measurement methods have been described. In relation to this, it can be referred to B. R. Glasberg & B. C. J. Moor, "Derivation of the auditory filter shapes from notched-noise data", Hearing Research, 47, 1990; P. Bonding et al., "Estimation of the Critical Bandwidth from Loudness Summation Data", Scandinavian Audiolog, Vol. 7, Nr. 2, 1978; V. Hohmann, "Dynamikkompression für Hörgeräte, Psychoakustische Grundlagen und Algorithmen", Dissertation UNI Göttingen, VDI-Verlag, Reihe 17, Nr. 93. The measurement of the loudness summation with specific broad-band signals according to the last-mentioned publication, for normal as well as for hearing impaired people, is suitable for the experimental measurement of the considered bandwidths of the critical bands.

With that, one can establish that:

- the individual $\alpha_{kI}$-parameters can be determined from the regression line according to FIG. 1,
- the individual hearing limits $T_{kI}$ can be determined by limit audiometry,
- the individual bandwidths $CB_{kI}$ of the critical bands can be determined according to the above-mentioned publications, whereas
- these variables are known and standardized for the standard, i.e. for the normal hearing people.

Nevertheless, the individual recording of the loudness graph and the scaling graph $L_{kI}$ according to FIG. 3 for the later determination of the model parameters $\alpha_{kI}$ and, if need be, of $T_{kI}$ and the known proceeding for the determination of the width of the critical bands $CB_{kI}$ are time consuming such that these proceedings, except within the scope of scientific research, can hardly be expected of an individual which is present for a clarification of his perception behavior.

A preferred proceeding should therefore be explained along with FIG. 4.

Besides, starting from the knowledge that, using standardized acoustic narrow-band signals $A_o$ which substantially lay centered in the critical frequency bands $CB_N$, the model parameters $CB_{kI}$ which are still unknown for the individual are set equal to the known $CB_{KN}$ without intolerable errors.

Furthermore, it will be assumed that the hearing limit $T_{kI}$ of an individual I have been determined in another measurement surrounding by the classic limit audiometry, since an individual which will be diagnosed in relation to its hearing behavior will be first examined in most of the cases by such an examination. For that, it is obvious that for the identification of the individual loudness model, i.e. its individual parameters, the $T_{kI}$ and $\alpha_{kI}$ will primarily be used.

According to FIG. 4, narrow-band standardized acoustic standard signals $A_{ok}$ which lay in the frequency bands $CB_{Nk}$ are fed to the individual I, as shown, for example, over a headset, electrically or by means of an electro-acoustic converter. For example, the individual I rates and quantifies the perceived loudness $L_s(A_{ok})$ over an input unit 5 according to FIG. 1.

According to the channel and according to the band, respectively, the signals $A_{ok}$ belong to, the standard bandwidth $CB_{kN}$ and the parameter $\alpha_N$ are provided over a selection unit 7 by a standard memory unit 9. The electrical signal $S_e(A_{ok})$ which corresponds to the sound pressure level of the signal $A_{ok}$ is fed to a processing unit 11 together with the corresponding bandwidth $CB_{kN}$, which processing unit 11, according to the preferred mathematical loudness model according to (1), calculates a loudness value $L'(A_{ok})$ by using $S_e$, $CB_{kN}$, $\alpha_N$ and, as mentioned before, the predetermined hearing level value $T_{kI}$ which has been saved in a memory unit 13.

From FIG. 5, it becomes apparent which loudness L' will be calculated by the processing unit 11 using these given parameters. By fixing the hearing limit $T_{kI}$ of the individual and of the parameter $\alpha_N$ Of the standard, a loudness value L' is determined in the processing unit 11 at a given sound level according to $S_e$ of the signals $A_{ok}$ as it corresponds to a scaling function N' which is defined by the regression line with $\alpha_N$ and by the hearing limit level $T_{kI}$ in first-order approximation.

Furthermore, according to FIG. 4, this loudness value L which is the output value of the processing unit 11 is compared in a comparison unit 15 with the loudness value $L_I$ of the input unit 5. The difference $\Delta(L', L_I)$ which is obtained at the output of the comparison unit 15 acts on an incrementing unit 17. The output of the incrementing unit 17 is superimposed by the $\alpha_N$-parameters which are fed to the processing unit 11 of the memory unit 9 in a superposition unit 19 taking into consideration the correct sign. The incrementing unit 17 is incrementing the signal according to $\alpha_N$ as long according to the number n of increments by the increment $\Delta\alpha$ as the difference obtained at the output of the comparison unit 15 reaches or falls short of a given minimum.

In regard to FIG. 5, this means that $\alpha_N$ at the course N' is modified as long as the loudness value L' which is calculated at the unit 11 equals the loudness value $L_I$ as required. With that, the processing unit 11 has found, starting from the course N', the regression line of the individual scaling graph I.

The output signal of the comparison unit 15 in FIG. 4 is compared with an adjustable signal $\Delta r$ according to a definable maximum error—as interruption criterion—at a comparator unit 21. When the difference signal $\Delta(L', L_I)$ which is an output signal of the comparison unit 15 reaches the value $\Delta r$, the increment of $\alpha$ is interrupted, as schematically shown, by the opening of the switch $Q_1$ and closing of the switch $Q_2$, on the one hand, and the $\alpha$-value which has been reached at this time is given out to the output of the measurement arrangement, on the other hand, according to $$\alpha' = \alpha_N + n\Delta\alpha$$

The following is valid:

$$\alpha'=\alpha_{kI}$$

With that, the parameter $\alpha_{kI}$ of the individual is found in the considered critical band k with the demanded accuracy according to $\Delta r$.

Through fixing of the interruption criterion $\Delta r$ in such a manner that the $\alpha_{kI}$-identification satisfies the practice-oriented accuracy demands, the method is optimally short, respectively, is only as long as necessary.

In FIG. 6*a*, in analogy to FIG. 5, the scaling function N of the standard and I of a heavily hearing impaired individual are again shown. At a given sound pressure level $S_{kx}$, an amplification $G_x$ must therefore be assigned to the hearing device, for that the individual with the hearing device perceives the loudness $L_x$ as the standard N. In FIG. 6*a*, several amplification values $G_x$ which are provided at the hearing device are shown in dependence on different sound pressure levels $S_{kx}$ which are shown as examples.

Figure 6:
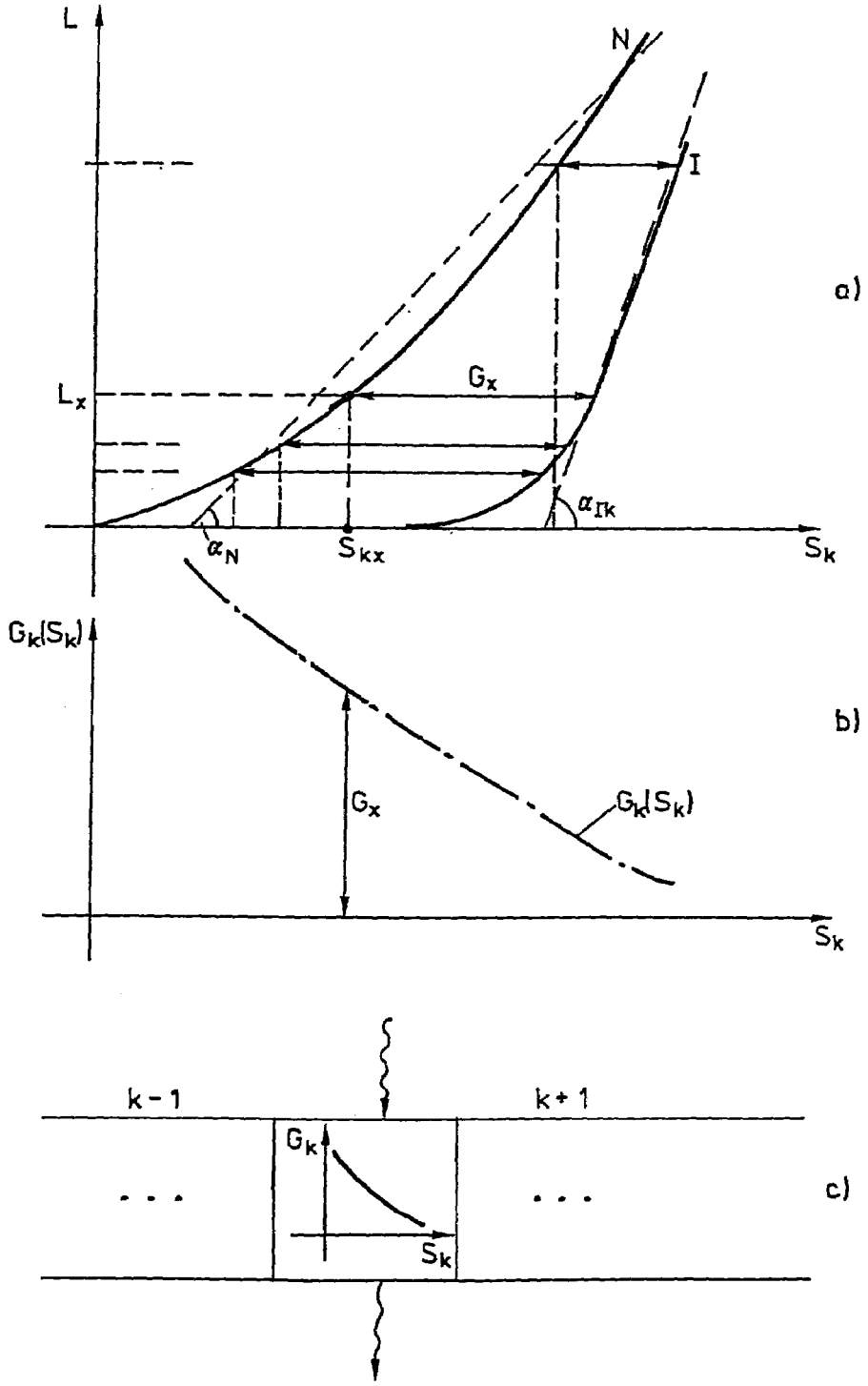

In FIG. 6*b*, the amplification course which results from the considerations in FIG. 6*a* is shown in function of $S_k$ which amplification course is to be realized at a transfer channel at the hearing device which transfer channel corresponds to the critical frequency band k, as is shown in FIG. 6*c*. From the parameters $T_{kI}$ and $\alpha_{kI}$, the differences $T_{kN}-T_{kI}$ and $n\Delta\alpha$, respectively, which have been described along with FIGS. 4 to 6, the nonlinear amplification course $G_k(S_k)$ which is presented heuristically and schematically in FIG. 6*b* is determined.

Optimally, the described proceeding is repeated in each critical frequency band k. For that, only one standardized acoustic signal must be presented to an individual for each critical frequency band and for an approximation with a regression line; further signals can be used, if need be, to prove the found regression lines.

From the considerations, in particular in regard to the FIGS. 4 to 6, it can easily be seen, that the proposed method can be extended through a simple extension to reach any precision regarding the approximation. An increase of the precision which is reached by a hearing device and with which an individual has the same loudness perception as the standard, is reached in view of FIG. 5 such that the scaling graphs are basically approximated through different regression lines in a piece wise manner in the meaning of a regression polygon.

The proceeding which is described along with FIGS. 4 to 6 is substantially based on the fact that the corresponding individual or standard scaling graph N or I, respectively, are only approximated through a couple of regression lines, namely for low sound pressure levels and for high sound pressure levels.

This also corresponds to the approximation with which the simulation model according to (1) considers the corresponding scaling courses in the critical frequency bands.

The preferred used model according to (1) will be more precise (1*) in that sound-pressure-level-dependent parameters $\alpha_k(S_k)$ will be used instead of level-independent parameters $\alpha_k$. In (1), $\alpha_k$ will be replaced by $\alpha_k(S_k)$.

This extended proceeding which starts by the conclusions described along with FIGS. 4 to 6 will be further explained with reference to FIGS. 7 and 8.

In FIG. 7, the function blocks which act in a similar way as the function blocks of FIG. 4 are provided with the same reference signs.

In FIG. 8, the scaling graph N of the standard and of an individual I are shown on the analogy of FIG. 5. In contrast to the approximation according to FIG. 5, the scaling graph N is approximated by the sound-pressure-level-dependent slope parameters $\alpha_N(S_k)$, that means by a polynom at the values $S_{kx}$ of the graph N. These sound-pressure-level-dependent parameters $\alpha_N(S_k)$ are assumed to be known in that they can be determined without difficulties by taking predetermined values $S_{kx}$ from the known scaling graph N of the standard.

On the analogy of the considerations regarding FIG. 5, through the arrangement according to FIG. 7 in consideration of the individual hearing level value $T_{kI}$ that is assumed to be known as before, the graph N', which is displaced by the individual hearing level value $T_{kI}$, is formed, at which graph N' the sound-pressure-level-dependent standard parameters $\alpha_N(S_k)$ are still valid. The latter will be changed as long as the graph N' is not in accordance with the scaling graph I of the individual by the desired precision. There are to rate at least as many level values $S_{kx}$ at the individual as are required by the desired number of used approximation tangents.

From the considered necessary changes of the sound-pressure-level-dependent parameters $\alpha_N(S_k)$, in regard to FIG. 6*b*, the precise course of the sound-pressure-level-dependent amplification which is adjusted channel-specifically at the hearing device, is determined.

For that, a set of sound-pressure-level-dependent slope parameters $\alpha_N(S_k)$ is saved in the memory unit 9 according to FIG. 7, apart from the bandwidths of the critical frequency bands $CB_{kN}$. Again, standard-acoustic, narrow-band signals which lie in the respective critical bands are presented to the individual I, but, in contrast to the proceeding according to FIG. 4, for each critical frequency band on different sound pressure levels $S_{kx}$.

The individual loudness rating for the standard acoustic signals of different sound pressure levels are preferably saved in a mediate memory unit 6. Through these memorized loudness perception values, referring to FIG. 8, the scaling graph I of the individual are fixed through fixing values.

Of the memory unit 9, the bandwidths $CB_{kN}$ which are assigned to the considered critical frequency band and the set of sound-pressure-level-dependent $\alpha$-parameters are led to the processing unit 11 apart from the previously determined, individual, band-specific hearing level $T_{kI}$.

As has been mentioned along with FIG. 4, here only presented in a simplified manner, the frequency of the standard acoustic signals determines the considered critical frequency band k, and, accordingly, the hereby relevant values are recalled from the memory unit 9. Preferably, the series F of the succeeding sound pressure level values $S_{kx}$ are further saved in a memory arrangement 10. As soon as the individual loudness perception values are recorded and saved in the memory unit 6, the series of the saved sound pressure level values $S_{kx}$ of the memory unit 10 are fed into the processing unit 11, with which the latter, according to FIG. 8, calculates the scaling graph N' using the hearing level value $T_{kI}$, the bandwidth $CB_{kN}$ and the sound-pressure-level-dependent slope values $\alpha_N(S_{kx})$, and determines therefore which loudness values according to the graph N' of FIG. 8 can be expected at a given sound pressure level $S_{kx}$.

At the comparison unit 15, referring to FIG. 8, all sound-pressure-level-dependent difference values $\Delta$ are determined, and through, if need be, different incremental adjustment of the sound-pressure-level-dependent standard parameters $\alpha_N(S_{kx})$, the sound-pressure-level-dependent coefficients are modified through the incrementing unit 17 and through the superposition unit 19, as represented by $\Delta'\alpha$, and, with that, the course of the calculated graph N' is modified until a sufficient approximation of graph N' and of graph I is reached.

For that, the difference which is obtained at the output of the comparison unit 15, here with the meaning of a sound-pressure-level-dependent course of differences between the graph S and the changed graph N' according to FIG. 8, is judged in relation to the falling short of a given maximum range—as interruption criterion—, and as soon as the mentioned deviations fall short of an asked value course, the optimization and increment process, respectively, is interrupted, on the one hand, and the sound-pressure-level-dependent α-parameters which are fed to the processing unit 11 are given out, on the other hand, which α-parameters correspond to the values for the tangential slope at the individual scaling graph I, i.e. $\alpha_{kI}(S_{kx})$ or $\Delta'\alpha_{kI}(S_{kx})$.

From these sound-pressure-dependent values, the nonlinear amplification function which are assigned to the specific critical frequency band are determined at the hearing device and are adjusted at it.

With that, it has been shown, how, with any precision, the necessary sound-pressure-level-dependent, nonlinear amplification of the hearing device transmission is determined in a channel that corresponds to the considered critical frequency band, and how it is used to adjust this channel.

Thereby, it has been assumed in first-order approximation that the width of the corresponding critical frequency band is irrelevant for the individual perception of a narrow-band signal, which is, as can be derived from (1), only correct as approximation.

The width of the critical frequency bands $CB_k$ will be relevant for the loudness perception of the individual at the time when the presented standard acoustic signals comprise spectrums that lie in two or more critical frequency bands, because loudness summation occurs according to (1) and (1*), respectively.

Until now, it has been found that deviations of the band-specific parameters αand T of an individual can be compensated by adjustment of the nonlinear level-dependent amplification of the channel of a hearing device which channel are assigned to the critical frequency bands. As mentioned above, the width of the critical frequency bands deviate individually, especially of heavily impaired people, from the standard, the critical frequency bands are usually wider than the corresponding of the standard.

A simple measuring method for the position and limits, respectively, of the critical frequency bands has been described by P. Bonding et. al., "Estimation of the Critical Bandwidth from Loudness Summation Data", Scandinavian Audiolog, Vol. 7, Nr. 2, 1978. Hereby, the bandwidth of presented standard acoustic test signals are continuously enlarged and the individual is scaling, as mentioned above, the perceived loudness. The average sound pressure level is thereby kept constant. At the position where the individual perceives a sensible increase of the loudness, the limit lies between two critical frequency bands, because loudness summation occurs at this point.

The determination of the width of the critical frequency bands $CB_{kI}$ is substantial for the individual loudness perception correction of broad-band acoustic signals, i.e. if loudness summation occurs. From the knowledge of the frequency band limits which deviate from the standard, the nonlinear amplification G of FIG. 6*b* are changed, now frequency-dependent, in the respective hearing device channels which are assigned to the critical bands, in particular in frequency bands which are not assigned to the same critical band for the individual as is given by the standard.

This will be explained along with FIGS. 9*a* and 9*b* in a simplified and heuristic manner.

Figure 9A:
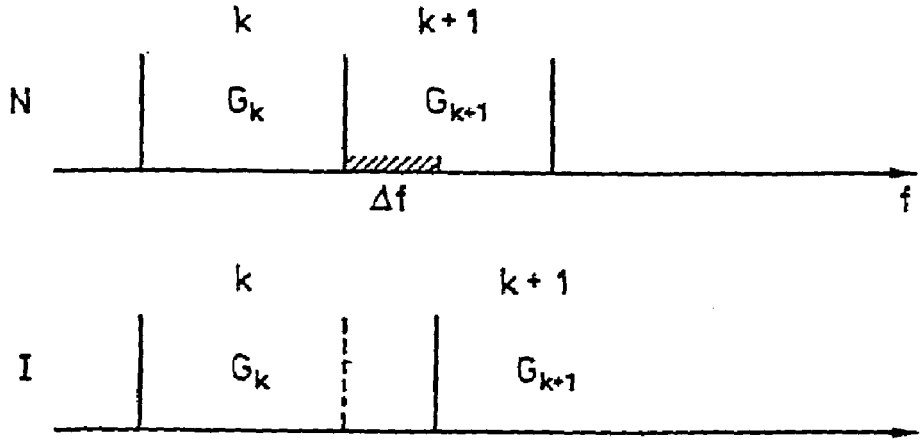

In FIG. 9*a*, critical frequency bands $CB_k$ and $CB_{k+1}$, for example, are drawn for the standard N above the frequency axis f. Below, in the same representation, the partially enlarged corresponding bands are draw for an individual I.

The nonlinear amplifications which have been found so far have been determined channel-specific or band-specific, respectively, in relation to the critical bandwidth of the standard. Considering the critical bandwidths of the individual, it can be seen from FIG. 9*a* that the hatched range Δf of the individual falls into the enlarged critical band k whereas, for the standard, it falls into the band k+1. From that, it follows that, considering the above-mentioned relation to the critical bandwidths of the standard, signals in the hatched frequency range Δf, for example, have to be corrected by changing its amplifications at the individual.

Figure 9B:
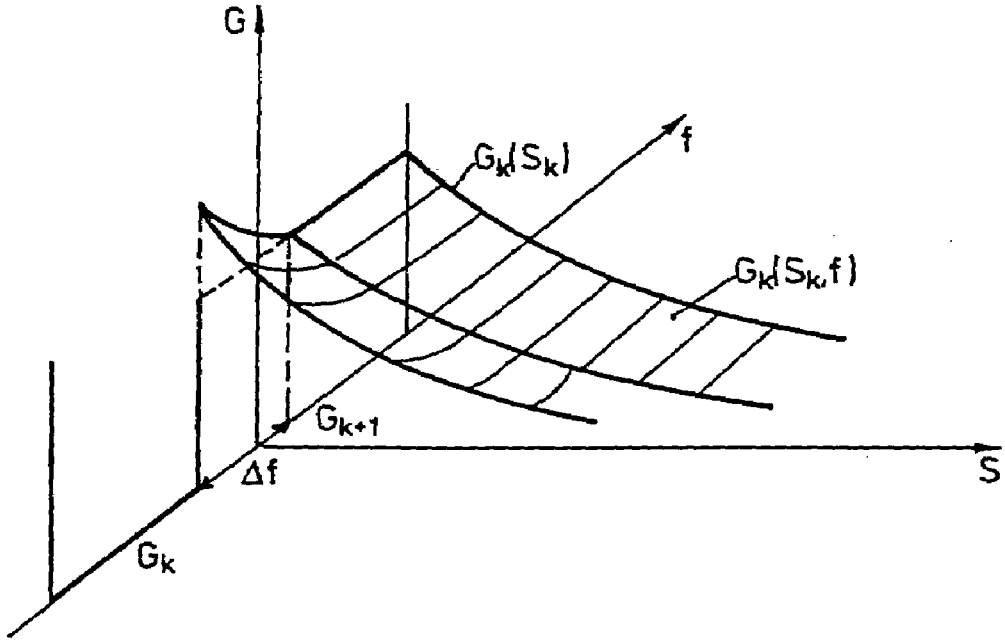

If therefore, according to FIG. 9*b*, signals which are transferred in a hearing device channel which corresponds to the critical frequency band k of the standard are amplified by the nonlinear level-dependent amplification function $G_k(S_k)$ which has been described above along with FIG. 6*b*, signals in the superposition range Δf must be additionally increased or, if need be, decreased in function of the frequency.

From the knowledge of the determined, as above-mentioned, channel-specific, nonlinear level-dependent amplifications $G_k(S_k)$ in the corresponding critical frequency bands and from the knowledge of the deviations of the critical frequency bands $CB_{kI}$ of the individual from the one $CB_{kN}$ of the standard, it is possible to compensate these deviations in a frequency-dependent manner through the amplifications $G_k(S_k, f)$ at the hearing device channels.

Obviously, it is possible, without further ado, to determine experimentally all the parameters α, T and CB which define the model according to (1) for the standard and for the individual, and to infer directly from the deviations of these coefficients to the correction adjustments of the hearing device. But such a proceeding asks for a channel-specific measuring of the individual, which, as mentioned above, is not suitable for clinical applications.

Starting with the proceeding according to FIG. 4 or 7, respectively, an advanced development is shown in FIG. 10 as function-block/signal-flow diagram for which the parameters $\alpha_k$ and $CB_k$ are determined by a single method. Not only one single critical band after the other are analyzed but also, with broad-band acoustic signals, the loudness summation are taken into consideration, and therefore the width of the individual critical bands are determined as variable through optimization.

In a memory unit 41, the simulation model parameters of the standard, namely $\alpha_N$ and $CB_{kN}$, are memorized as well as, in a preferred embodiment, not the hearing levels TkN of the standard but the determined hearing limits $T_{kI}$ of the examined individual, which hearing limits $T_{kI}$ are determined through audiometry in advance and which hearing limits $T_{kI}$ are read from a memory unit 43.

To an individual, broad-band signals $A_{\Delta k}$ which overlap critical bands are acoustically presented by a generator which is not shown. The electrical signals of FIG. 10 which signals correspond to the above-mentioned signals $A_{\Delta k}$, in FIG. 10 also referenced by $A_{\Delta k}$, are fed to a frequency-selective power measuring unit 45. In the unit 45, the channel-specific average power is determined according to the critical frequency bands of the standard in a frequency-selective manner, and, at the output, a set of such power values $S_{\Delta k}$ are given out. Channel-specific and specific for the respective presented signal $A_{\Delta k}$ (A-Nr.), these signals are saved in a memory unit 47. At the presentation of one of the respective signals $A_{\Delta k}$, all coefficients which are memorized in the memory unit 41 are, for the time being, fed unchanged, over a unit 49 in the calculation unit 51, which unit 49 is yet to be described, to a calculation module 53, as well as the power signals $S_{\Delta k}$ which correspond to the prevailing signals $A_{\Delta k}$. The calculation module 53 calculates the loudness L' according to (1) from the standard parameters $\alpha_N$ and $CB_{KN}$ as well as the hearing limit values $T_{kI}$ of the individual, under consideration of the loudness summation, which loudness L' is obtained for the standard if the latter had the same hearing limits ($T_{kI}$) as the individual.

For each presented signal $A_{\Delta k}$, assigned to the signal, the calculated value $L'_N$ is saved in a memory unit 55 at the output of the calculation module 53. Each presented acoustic broad-band (Δk) signal $A_{\Delta k}$, as has been described along with FIGS. 4 and 7, respectively, is rated and classified, respectively, in relation to the loudness perception of an individual, the rating signal $L_I$, again assigned to the respective presented acoustic signals $A_{\Delta k}$, is saved in a memory unit 57. As for the determination of $L'_N$ as also for the determination of $L_I$, the loudness summation is considered by calculation through the individual on grounds of the broad-bandness Δk of the presented signals $A_{\Delta k}$.

After presentation of a given number of signals $A_{\Delta k}$, the respective number of values $L'_N$ is saved in the memory unit 55 and the respective number of $L_I$-values is saved in the memory unit 57.

For now, the presentation of acoustic signals is interrupted, the individual is no longer inconvenienced. All assigned $L'_N$ -and $L_I$-values which, each drawn in function of the number of the earlier presented acoustic signals $A_{\Delta k}$, each forming a course, are fed to a comparison unit 59 in the calculation unit 51 which determine the course of difference $\Delta(L'_N, L_I)$. This course of difference is fed to the parameter modification unit 49, in principle similarly to an error signal of a closed-loop control system.

The parameter modification unit 49 varies the starting values $\alpha_N$ and $CB_{kN}$, but not the $T_{kI}$-values, for all critical frequency bands, at the same time, of the respective new calculation of the actualized $L'_N$-values as long as the course of the difference signal $\Delta(L'_N, L_I)$ lies in a given minimal course is checked by the unit 61.

If the interruption criterion ΔR is not reached yet, further acoustic signals must be processed.

Therefore, the standard parameter $\alpha_N$ and $CB_{kN}$ which are fed as starting values are varied in the simulation model according to (1) by the individual hearing limits $T_{kI}$ in consideration of the respective signals $S_{\Delta k}$ using given search algorithms, which signals are recalled from memory unit 47 and which signals correspond to the channel-specific sound pressure values, as long as a maximum allowable deviation between the $L'_N$- and the $L_I$-courses is reached.

As soon as the reaching of a given maximum deviation criterion ΔR is registered through the difference $\Delta(L'_N, L_I)$ that is obtained at the output of the unit 59, the search process is interrupted; the α- and CB-values which are obtained at the output of the modification unit 49 correspond to the ones which, applied to (1), result in loudness values which correspond to the individually perceived values $L_I$ for the presented acoustic signals $A_{\Delta k}$ in an optimal manner: Through the variation of the standard parameters, the individual parameter are again determined.

Through the parameter values which are obtained at the output of the modification unit 49 at interruption of the search and through the difference of these parameters in regard to the starting values $\alpha_N$ and $CB_{kN}$, adjustment variables are determined to adjust the amplification functions of the frequency-selective channels of the hearing device.

As is evident by now, the point of the described proceeding is actually the determination of a minimum of a multivariable function. In most cases, several sets of changed parameters lead to the accomplishment of the minimum criterion which is defined by ΔR. The described proceeding can therefore lead to obtain several such sets of solution parameters, whereas those sets are used for the physical adjustments of the hearing device which make sense physically and which are, for example, realized in the most easy way.

Sets of solution parameters, which can be excluded in advance, which only lead, for example, to very difficult or not realizable amplification courses at the respective channels of the hearing device, can be excluded in advance through a corresponding pretext at the modification unit 49.

A shortening of the search process, i.e. for heavily hearing impaired individuals, can further be reached in that the $\alpha_{kI}$- and $CB_{kN}$-values, respectively, which are estimated from the individual hearing limits $T_{kI}$ for hearing impaired people, are saved in the memory unit 41 as search starting value, especially if a heavy hearing impairment is diagnosed in advance.

Obviously, the calculation unit 51 can also comprise the mentioned memory unit s as hardware; its delimitation which is marked by dashed lines in FIG. 10 is understood, for example, comprising the calculation module 53 and the coefficient modification unit 49.

The proceeding which has been described so far according to FIGS. 4, 7 and 10, respectively, can readily be used for the ex situ adjustment of a hearing device. Presumably, the determined adjustment variables can be directly and electronically transferred to the in situ hearing device, whereas the actual advantage of an in situ adjustment, namely the consideration of the fundamental hearing influence through the hearing device, is not considered: First, all adjustment variables are determined without a hearing device and, after that, without further acoustic signal presentations, the hearing device is adjusted.

If, nevertheless, the fundamental considerations are reconsidered in connection with FIGS. 4, 7 and 10, it can be seen that the reflections which have been particularly made in the context of the ex situ-adjustment of a hearing device can readily be applied to the "on line"-adjustment of a hearing device in situ. Instead of, as has been described so far, adapting a given loudness model according to the simulation model with given parameters to a model of an individual or, if need be, vice versa, and, finally, adjustment variables are determined from that for the hearing device, it is possible, without further ado, to adjust the hearing device in situ as long as the loudness which is perceived by the individual is equal to the standard.

Thereby, it is quite possible to use the valuation of the loudness perception by the individual to determine whether a performed incremental parameter change at the hearing device, according to FIGS. 4 or 7, leads towards or away from a change of the loudness perception in regard to the standard. Nevertheless, it should be avoided that an individual is too heavily loaded by the hearing device adjustment in a unreasonable manner.

Regarding the proceeding which has been described along with FIG. 10, it is obvious that this proceeding is optimally suitable for the in situ-hearing device adjustment. The preferred manner to proceed in this case shall be described along with FIG. 11, in which functional blocks which correspond to those in FIG. 10 are referred to the same reference signs. The proceeding corresponds, apart from the differences which are described as follows, to the one which is described along with FIG. 10.

The acoustic signals $A_{\Delta k}$ are fed to the system hearing device HG with converters 63 and 65 at its input and at its output and to the individual I that loads the perceived $L_I$-values into the memory 57 by the valuation unit 5.

Exactly in the same manner as has been described along with FIG. 10, the $L_I$-value is saved for each presented standardized acoustic broad-band signal $A_{\Delta k}$ in the memory 57. With the power values $S_{\Delta k}$ of the memory unit 47 according to FIG. 10 and the standard parameter values from the memory unit 41, the loudness values $L'_N$ as have been described along with FIG. 10, are calculated using the calculation module 53 according to (1) or (1*) for the time being, and, specifically assigned to the presented signals $A_{\Delta k}$, stored in the memory unit 55. Over the comparison unit 59 and the modification unit 49, the standard parameters from the memory unit 41 are subsequently modified, as has been described, as long as they, using (1) or (1*), lead to $L'_N$-values with given precision, which $L'_N$-values correspond to the $L_I$-values in the memory 57.

From that, it follows:

$$\alpha'_{Nk}=\alpha'_N\pm\Delta\alpha_k,\ CB'_{Nk}=CB_{Nk}\pm\Delta'CB_k$$

and $$L'_N=L_I \text{ for all } A_{\Delta k}$$

With that, the following is also valid:

$$\alpha'_{Nk=\alpha Ik},\ CB'_{Nk}=CB_{Ik}$$

With that, it is also found that, if the hearing device transmits input signals with a correction loudness $L_{Kor}=L_{Kor}$ ($\pm\Delta\alpha_k$, $\pm\Delta CB_k$, $\Delta T_k$), whereas $\Delta T_k=T_{kI}-T_{kN}$, the overall system, including the hearing device and the individual, perceives a loudness according to the standard.

The hearing device HG comprises, as has been described in principle along with FIG. 6*c*, a number $k_0$ of frequency selective transmission channels K between the converter 63 and the converter 65. Over a corresponding interface, control elements are connected to a control unit 70 for the transfer behavior of the channels. To the latter, the starting control variables $SG_o$, which have been optimally determined in advance, are fed.

After, starting from the standard parameters, the modified parameters $\alpha'_{Nk}$ and $CB'_{Nk}$ have been determined for a previously defined number of presented standard-acoustic broad-band signals $A_{\Delta k}$ using the calculation module 53 and the modification unit 49, with which modified parameters, according to FIG. 8, the scaling graphs N' are adjusted to the ones of the individual I with still unadjusted hearing device HG, the found modifications of the parameters $\pm\Delta\alpha_k$, $\pm\Delta CB_k$, $\pm\Delta T_k$ or the parameters $_N$, $T_{kN}$, $CB_{kN}$ and $\alpha_{kI}$, $T_{kI}$, $CB_{kI}$ have influence on the hearing device over the adjustment variables-control unit 70 in such a controlling manner that the channel-specific frequency and magnitude transfer behavior of the hearing device generate, at the output, the correction loudness $L_{Kor}$.

While the proceeding according to FIGS. 10 and 8, the parameters of the standard are modified as long as the scaling graphs N' correspond to the scaling graphs I, and, for that, the hearing limits $T_{kN}$ are not used, but are only used for the determination of the amplifications of the hearing device channels according to FIG. 6*b*, the hearing limits of the individual are, according to FIG. 11, also saved in memory 43 and the standard hearing limits which are saved in memory 44 are used.

From the parameter modifications which are determined in FIG. 11 analogously to the proceeding according to FIG. 10, to transform N' to I, as in FIG. 8, and from the differences of the hearing limits, control variables changes ΔSG for the channel-specific frequency and magnitude transfer behavior of the hearing device are determined in the control variables determination unit 70 according to FIG. 11 in such a manner that the scaling graphs of the individual I by the hearing device HG are getting close to the scaling graphs N of the standard with the desired precision:

The loudness behavior of the hearing device maps the intrinsic, i.e. "own" loudness perception of the individual onto the standard, the loudness perception of the individual with the hearing device is equal to that of the standard or is, in relation to the standard, definable.

In contrast to an "ex situ"-adjustment of the transfer behavior of a hearing device, the "in situ"-adjustment which is represented, for example, in FIG. 11 comprises the substantial advantage that the physical "in situ" transfer behavior of the hearing device and, for example, the mechanical ear influence are considered by the hearing device.

In FIGS. 12*a*) and *b*), two principle implementations of a hearing device according to the present invention are represented by simplified signal-flow-function-block diagrams which are adjusted "ex situ", but preferably "in situ".

The hearing device, as represented in FIGS. 12*a*) and *b*), shall, optimally adjusted, transfer received acoustic signals with the correction loudness $L_{Kor}$ to its output such that the system "hearing device and individual" has a perception which is equal to the one of the standard, or (ΔL of FIG. 12*a*) deviates from it in a definable degree.

According to FIG. 12*a*), channels 1 to $k_o$, which are each assigned to a critical frequency band $CB_{kN}$ and which are connected to an acoustic-electronic input converter 63, are provided at a hearing device according to the present invention. The total of these transfer channels form the signal transfer unit of the hearing device.

The frequency selectivity for the channels 1 to $k_o$, is implemented by a filter 64. Each channel further comprises a signal processing unit 66, for example multiplicators or programmable amplifiers. In the unit s 66, the nonlinear, afore-described band- or channel-specific amplifiers are realized.

At the output, all signal processing units 66 act on a summation unit 68 which, at its output, acts on the electric-acoustic output converter 65 of the hearing device. Insofar, the two embodiments correspond to each other according to FIGS. 12*a*) and 12*b*).

For the embodiment according to FIG. 12*a*), which principle is hereinafter called "correction model", the acoustic input signals which are obtained at the output of the converters 63 are converted into their frequency spectrums in a unit 64*a*. With that, the foundation is laid to compute the acoustic signals, in the frequency domain, in a calculation unit 53' using the loudness model according to (1) or (1*), parametrized by the afore-described found correction parameters $\Delta\alpha_k$, $\Delta CB_k$, $\Delta_k$, i.e. corresponding to the correction loudness $L_{Kor}$. In the calculation unit 53', the mentioned channel-specific correction parameters as well as the corresponding correction loudness $L_{Kor}$ are converted into adjustment signals $SG_{66}$, whereby the units 66 are adjusted.

Thereby, the variables ΔSG which are fed, according to FIG. 11, to the hearing device, according to FIG. 12*a*), substantially correspond to channel-specific correction parameters in this embodiment. Through controlling the transfer behavior of the hearing device by the units 66 in function of the respective actual acoustic input signals and the corresponding valid correction parameters, it is achieved that the hearing device transfers the mentioned input signals with the correction loudness $L_{Kor}$. Thereby, the system "individual with hearing device" perceives the required loudness, being equal to the standard, as preferred, or referring to this in a given proportion.

For the embodiment according to FIG. 12*b*) which is called "difference model" in the following, the spectrums are formed of the converted acoustic input signals as well as of the electric output signals of the hearing device by units 64*a*. In a calculation unit 53*a*, the actual loudness values are computed on grounds of the input spectrums as well as of the loudness model parameters of the standard N. which loudness values would be perceived by the standard on grounds of the input signals. Analogously, the loudness values are computed in a calculation unit 53*b* on grounds of the output signal spectrums, which loudness values are perceived by the individual, i.e. the intrinsic individual, without hearing device. Hereby, the model parameters of the individual are fed to the simulating calculation unit 53*b*, which model parameters are determined as described before.

A controller 116 compares, on the one hand, the loudness values $L_N$ and $L_I$ which are determined by simulation of the standard and of the individual as well as, channel-specific, the parameter of the standard model and of the individual model and gives, at the output, corresponding to the determined differences, adjustment signals $SG_{66}$ to the transfer unit 66 in such a way that the simulated loudness $L_I$ becomes equal to the actual required standard loudness $L_N$ .

Unlike to the correction model embodiment of FIG. 12*a*), the controller 116 determines the respective necessary correction loudness $L_{Kor}$ according to FIG. 12*b*), first.

With the difference model embodiment according to FIG. 12*b*), the hearing device transmission is also adjusted in the units 66 in such a manner that the actual acoustic signal is transferred with the correction loudness, so that the simulation of the loudness results, at the output signals, in a loudness corresponding to the one perceived by the standard or referring to it in a definable ratio.

Summarizing, it can be said therefore:

that, as has been described along with FIGS. 1 to 11, starting from a given mathematical standard loudness model, parameter changes are determined which correspond to the loudness sensitivity difference of the standard and of the individual. With that, model differences and individual model are known.

At a hearing device, the same mathematical model is used.

The loudness model of the hearing device is operated in function of the parameter differences (Δ) which are used to adjust the loudness model of the individual to the one of the standard, for which the found model parameter differences and/or the standard parameters and the individual parameters are fed to the hearing device.

At the hearing device model, regarding the afore-mentioned case, it is continuously checked if the loudness which has been computed from the momentary input signals according to the model of the standard also corresponds to the loudness which has been computed from the individual model on grounds of the output signals. On grounds of the model parameter differences and, if need be, of the simulated loudness differences, the transfer at the hearing device is led in such a controlling manner that simulated loudness $L_I$ and $L_N$ are coming into definable relation, preferably become equal.

Referring back, for example, to FIG. 10 or 11, it can be seen without further ado that the function of the therein described "ex situ" processing unit, in particular of the calculation unit 53, of the modification units 49 and 70, are directly perceived by the controlling unit 71 at the hearing device. The combination of the procedure according to FIG. 11 with a hearing device according to FIG. 12, namely require calculation units that compute both the same loudness model, sequentially with other parameters.

An embodiment of a hearing device according to the present invention, combining the procedure according to FIG. 11 and the structure according to FIG. 12*a*), is represented in FIG. 13. For the same functional blocks, there are used the same reference signs as in FIG. 11 or 12, respectively. For reasons regarding its clearness, only one channel X of the hearing device is shown. At the beginning, a switching unit 81 connects the memory unit (41, 43, 44) according to FIG. 11, here represented as a unit, with the unit 49. A switching unit 80 having an open switch is represented, a switching unit 84 is also effective in represented position.

In this switching positions, the arrangement exactly operates as is shown in FIG. 11 and has been described in this context. After going through the tuning procedure which has been described along with FIG. 11 the determined parameter changes $\Delta\alpha_k$, $\Delta CB_k$, $\Delta T_k$ which transform the individual loudness model (I) into the standard loudness model (N) are loaded into the memory units 41', 43', 44', which analogously operate as the memory unit 41, 43, 44, through switching of the switching unit 80. The switching unit 81 is switched to the output of the last-mentioned memory unit . At the same time, the modification unit 49 is deactivated (DIS) such that it directly supplies the data from the memory units 41' to 44' to the calculation unit 53*c* in an unmodified and unchanged manner.

The switching unit 84 is switched such that the output of the calculation unit 53*c*, now effective as calculation unit 53' according to FIG. 12*a*), acts on the transfer path with the units 66 of the hearing device over the adjustment variables control unit 70*a*. Preferably, $\Delta Z_k$-parameters $\Delta\alpha_k$, $\Delta CB_k$, $\Delta T_k$, represented by the dashed line, act on the adjustment variables control unit 70*a* beside $L_{Kor}$.

In that way, the loudness model calculation unit 53*c* which is incorporated into the hearing device is used, for the time being, to determine model parameter changes $\Delta\alpha_k$, $\Delta CB_k$, $\Delta T_k$, which are necessary for the correction, and then, in operation, for the time-variant guidance of the transfer adjustment variables of the hearing device—according to the momentary acoustic circumstances.

Sound Optimization

The determination of the correction loudness model parameters at the hearing device and, with that, of the necessary adjustment variables for, in general, nonlinear channel-specific amplifications, for example for a heavily hearing impaired person, allows different target functions, or it is possible to reach the required loudness demands as a target function, as mentioned, with different sets of correction loudness model parameters and, therefore, adjustment variables $SG_{66}$.

It is the general scope to rehabilitate the individual, i.e. the heavily hearing impaired person, in such a way that the individual is perceiving as the standard again. This aim, namely that the individual perceives the same loudness perception with the hearing device as the standard, must not already be the optimum of the individual hearing need, especially in regard to the sound.

One has to start from the fact that the individual deviations from the mentioned aim, i.e. the adjustment of the loudness at the isophones of an average normal hearing person, is perceived as normal in praxis, if one wants to consider a fine tuning at all, taking into account the above, namely optimization of the hearing device parameters for the optimal acoustic sound perception.

From experience, the so called sound parameters are mainly related to the frequency spectrum of the transfer function of the hearing device. In the range of high, medium and low frequencies, the amplification should therefore be increased some times and/or decreased to have influence on the sound of the device, as is readily done for hi-fi-systems.

But if the amplification is frequency-selectively increased, i.e. in certain transmission channels, at a hearing device which is optimally adjusted in relation to isophones of the standard as has been described so far, the correction loudness is changed therewith.

With that, it is a further object to change the correction parameter set, which is used hereby, at a loudness-optimized hearing device in such a manner that, on the one hand, the sound perception is changed, and, on the other hand, the formerly reached aim, i.e. individual loudness perception with hearing device as the standard, is retained.

On grounds of the multi-parametrized optimization task, which leads to the accomplishment of the loudness need, several sets of parameters, as mentioned before, may result in solutions, that means, it is absolutely possible to precisely modify parameters of the correction loudness model and to ensure the retention of the loudness need through the modification of other model parameters.

This shall be explained along with FIG. 14, starting from FIG. 11.

FIG. 14 shows the measures which are to be taken in addition to the precautions of FIG. 11; the same function blocks which are already shown in FIG. 11 and with that explained, are referenced by the same reference signs.

With that, it is obvious that the following explanations are also valid for the system according to FIG. 13 as well as for the adjustment of the hearing device according to FIGS. 12*a*) and *b*). On grounds of a better clearness, the measures to be taken are however represented starting from FIG. 11.

In relation to the sound perception, judgment criterions, as they have been described by Nielsen for example, exist, namely sharp, shrill, dull, clear, hollow, to mention only a few.

In analogy to the quantification of the loudness perception or to the loudness scaling, as have been described along with FIG. 1, a sound perception which is arranged in specific categories can numerically be scaled, e.g. according to the described and known criteria of Nielsen. After that, according to FIGS. 14 and 11, respectively, the hearing device HG is adjusted by finding a correction parameter set ($\Delta\alpha_k$, $\Delta CB_k$, $\Delta T_k$) in such a way that the individual has, at least approximated, the same loudness perception with the hearing device as the standard, the individual inputs, for example for the same presented broad-band standardized acoustic signals $A_{\Delta k}$, its sound perception to a sound scaling unit 90. In the unit 90, a numerical value is assigned to each sound category. In a difference unit 92, the individually quantified sound perception $KL_I$ is compared with the statistically determined sound perception $KL_N$ of the standard at the same acoustic signals $A_{\Delta k}$. These are saved in a recallable memory unit 94.

Now, conclusions are directly possible from the sound perception statement of the individual in relation to the spectral composition of the perceived signals by the individual. If, for example, the loudness perception of the individual by the loudness-tuned hearing device is too shrill, it can be seen without further ado that the amplification of at least one of the high-frequency channels of the hearing device is to be decrease. But, the loudness change which is created by that has to be undone by an intervention on channels which participate at the loudness formation, i.e. with corresponding amplification changes, not to abandon the already reached goal further on. If sound perception of the individual with the loudness-tuned hearing device deviates from the one of the standard, a sound-characterizing unit 96, according to FIG. 14, is activated, for example, between comparison unit 59 and parameter modification or increment unit 49, respectively, which limits the parameter modification in its degree of freedom in the unit 49, i.e. one or several of the mentioned parameters, independent of the difference which is minimally obtained by the unit 59, are changed and held constant.

Now, the error criterion $\Delta R$ which is not any more represented in FIGS. 11 and 14, respectively, must recently be satisfied as interruption criterion according to FIG. 10; by holding the mentioned parameter, the still free parameters are changed by the unit 59 as long as the loudness, corresponding to the standard, is perceived $L_I = L'_N$–, but only with a changed sound.

Thereby, the sound-characterizing unit 96 is preferably connected to an expert database, schematically represented at 98 of FIG. 14, to which database the information is supplied regarding individual sound perception deviation from the standard. In the expert database 98, information is stored, for example, as "shrill at $A_{\Delta k}$ is the consequence of too much amplification in the channels with number . . . "

If "shrill" is perceived, starting from the expert database and the sound-characterizing unit 96, the amplification is decreased in one or in several high-frequency channels of the hearing device, with which the interruption criterion $\Delta R$, according to FIG. 10, —is not fulfilled at the comparison unit 59 anymore and a new search cycle is started for the correction model parameters, but with decreased amplification, which is prescribed by the expert database, in higher frequency channels of the hearing device.

A specific constellation of, at the same time, prevailing correction coefficients $\Delta\alpha_k$, $\Delta CB_k$ and $\Delta T_k$ can be considered as band-specific state vector $Z_k(\Delta\alpha_k, \Delta CB_k, T_k)$ of the correction loudness model in the considered critical band k. The total of all band-specific state vectors $Z_k$ forms the band-specific state space which is, in this case, three-dimensional. For each sound feature which can occur at the sound scaling, band-specific state vectors $Z_k$ are primarily responsible, for "shrill" and "dull" in high-frequency critical bands. This expert knowledge must be stored as rules in the sound-characterizing unit 96 or in the expert system 98, respectively.

If the band-specific correction state vectors $Z_k$, which result in a loudness perception of the individual with a hearing device that is substantially the same as the of the standard as mentioned before, are found, a modified state vector $Z'_k$ must be found for the sound modification at least in one of the critical frequency bands. Thereby, by modifying of one of the state vectors, either this modified state vector must be further changed for that the loudness remains equal or at least one additional band-specific state vector must therefore also be changed. With that, the parameters of the correction loudness model of the hearing device are obtained, starting by the parameters of the standard, from a first incremental modification "Δ" for the loudness modification which corresponds to the standard and as second incremental modifications δ for the sound tuning.

The correction loudness model of the hearing device, for example according to FIG. 12*a*), uses parameters of the kind $$\alpha_{Kor=\pm\Delta\alpha k}\pm\delta\alpha_k;\ CB_{Kor}=\pm\Delta CB_k\pm\delta CB_k;\ T_{Kor}=\pm\delta T_k.$$

For each new found or steered band-specific state vector at the hearing device model, $Z'_k$, which should arrange a new sound for the individual, the corresponding adjustment variables according to FIGS. 12*a*), 12*b*) and 13, respectively, are switched to the adjustment elements at the hearing device channels, and through that the hearing device is newly adjusted, whereupon the individual, at a loudness perception still corresponding to the standard, judges the sound quality and accordingly submits it to the unit 90 according to FIG. 14. This process is repeated as long—i.e. sign corrected, new $\delta\alpha^k$, $\delta CB_k$ and $\delta T_k$ are searched again and again—as the individual which is equipped by a hearing device is perceiving the presented acoustic signal in a satisfactory manner, and, for example, also judges its sound quality in the same way as the standard.

Instead of an absolute statement regarding the sound quality which is oriented at the statement of normal hearing people (memory 94) by the above-described interactive procedure, also different iterative comparing, relative test procedures, for example by Neuman and Levitt, have proved to be useful for the sound perception optimization. Therefore, it is absolutely possible to compute a number of channel-specific state vector sets which belong together and which, each of them, satisfies the loudness criterion as has been described, through that, each time when the interruption criterion ΔR is reached, according to FIG. 10, a new calculation cycle is performed, for example with a modified channel-specific state vector. After that, the individual can determine a set of channel-specific state vectors, which optimally satisfy the individual regarding the sound, out of all sets of channel-specific state vectors which determined set is, for example, found in a systematic selection procedure and which determined set satisfies the loudness requirements.

In FIG. 15, again as functional block diagram, the hearing device according to the present invention and according to FIG. 12*b*) (model difference embodiment) is represented in such a manner as it is preferably realized. On grounds of a better clearness, the same reference signs are used as have been used for the hearing device according to the invention according to FIG. 12*b*).

The output signal of the input converter 63 of the hearing device is subjected to a time/frequency transformation in a transformation unit TFT 110. The resulting signal, in the frequency domain, is transferred to the frequency/time-domain-FFT transformation unit 114 in the multi-channel time-variant loudness filter unit 112 by the channels 66, and, from there, in the time domain, transferred to the output converter 65, for example a loud speaker or another stimulus transducer for the individual. In a calculation part 53*a*, the standard loudness $L_N$ is computed from the input signal in the frequency domain and the standard model parameters corresponding to $Z_{kN}$.

Analogously, the individual loudness $L_I$ is calculated at the output of the loudness filters 112. The loudness values $L_N$ and $L_I$ are fed to the control unit 116. The control unit 116 adjusts the adjustment elements, as the multiplicators 66*a* or programmable amplifiers, such that $$L_I=L_N.$$

With this hearing device according to the present invention, the individual loudness is corrected to obtain the standard loudness in that the isophones of an individual are adjusted to the ones of the standard.

Loudness-corrected Frequency Masking

Although the target function "standard loudness" and, if need be, also the sound perception optimization are obtained by the hearing device according to the present invention as, for example, represented in FIG. 15, the articulation of the language is not fully optimized. This results from the masking behavior of the human ear which is, for an impaired individual ear, different from the standard. The frequency masking phenomenon states that low sounds in close frequency neighborhood are faded out by loud sounds, i.e. that they do not contribute to the loudness perception.

To further increase the articulation, it has to be assured that those spectral parts which are present to the standard in a unmasked manner and are therefore perceived, are also perceived by the impaired individual ear which is mostly characterized by an increased masking behavior. For the impaired ear, usually frequency components are masked which are unmasked for the standard ear.

FIG. 16 shows, starting from the representation of the so far described inventive hearing device according to FIG. 15, a further development, for which a masking correction for a heavily hearing impaired individual, i.e. a frequency masking, is performed apart from the loudness correction of the individual. Moreover, it can be stated in advance that through the modification of the masking behavior of the hearing device and, therefore, of its frequency transfer behavior, the loudness transfer is also modified, with that, after modification of the frequency masking behavior, the loudness transfer must be newly adjusted.

According to FIG. 16, the input signal of the hearing device is fed to a standard masking model unit 118*a* in the frequency domain, in which unit 118*a* the input signal is masked in the same way as by the standard. How the masking model is determined will be explained later on.

The output signal of the hearing device in the frequency domain is analogously fed to the standard masking model unit 118*b*, in which the output signal of the hearing device is subjected to the masking model of the intrinsic individual. The input and output signals which are masked by the models N and I are fed to the masking controller 122 and compared in it. The controller 122 controls the masking filter 124 in function of the comparison result as long as the masking "hearing device transfer and individual" are equalized with the one of the standard.

To the multi-channel time-variant loudness filter 112, the also multi-channel time-variant masking filter 124 is connected which is adjusted in function of the difference, as mentioned, determined by the masking controller 122 in such a way that the standardized-masked input signal in the unit 118*a* becomes equal to the "individual and hearing device"-masked output signal of the unit 118*b*. If the transfer behavior of the hearing device is modified by the masking controller 122 and by the masking filter unit 124, the correction loudness $L_{Kor}$ of the transmission does not correspond to the required one anymore, and the loudness controller 116 adjusts the adjustment variables at the multi-channel-time-variant loudness filter 112 in such a way that the controller 116 establishes the same loudness $L_I$, $L_N$ again.

The masking correction by the controller 122 and the loudness modification by controller 116 are therefore performed iteratively, whereby the used loudness model, defined through the state vectors $Z_{LN}$ and $Z_{LI}$, are unchanged. Only when the correspondences which are obtained by the iterative tuning of the filters 112 and 124, respectively, are reached for the loudness controller 116 as well as for the masking controller 122 within narrow tolerances, the transferred signal is transformed back to the time domain by the frequency/time transformation unit 114 and is transferred to the individual.

Analogously, the loudness model, the frequency-masking model is parametrized by state vectors $Z_{FMN}$ and $Z_{FMI}$ respectively.

Along with FIG. 17, starting, for example, from the represented masking behavior of normal hearing people N, the masking behavior of heavily hearing impaired individuals I is explained, and the masking correction is explained in a greatly simplified representation.

If, according to the representation N of FIG. 17, a static acoustic signal, for example with the represented three frequency components $f_1$ to $f_3$, is presented to the human ear, a masking graph $F_{fx}$ is assigned to each frequency portion corresponding to its loudness. Only those level portions which surpass the masking limits, corresponding to the $F_f$-functions, contribute to the sound and loudness perception of the presented broad-band signal, for example with the frequency components $f_1$ to $f_3$. For the represented constellation, the standard perceives a loudness to which the non-masked portions $L_{ff1N}$ to $L_{f3N}$ contribute. Substantially, the slopes $m_{unN}$ and $m_{obN}$ of the masking course $F_f$ are, in a first-order approximation, frequency- and level-independent, if, as represented, the frequency scaling is done in "bark", according to E. Zwicker (in critical bands).

For a heavily hearing impaired individual I, the masking courses $F_f$, in relation to slope m, are enlarged, and are lifted in addition to that. This can be seen from the representation for a heavily hearing impaired individual I in FIG. 17, below, according to which, at the same presented acoustic signals with the frequency components $f_1$ to $f_3$, the component with frequency $f_2$ is not perceived, and therefore also does not contribute to the perceived loudness. By dashed lines, the frequency masking behavior of the individual I is again represented in the characteristic I of FIG. 17.

In the following, the point is to realize a filter chzaracteristic through a "frequency-demasking filtering" for a hearing device for the individual I which filter characteristic corrects the masking behavior of the individual to the one of the standard. As is principally represented in FIG. 17 by 126, this is realized through a filter preferably in each channel of the hearing device to which channel a critical frequency band is assigned each, which filter, in total, amplifies the frequency portions which are, for example, masked out by the impaired individual by frequency-dependent amplification G' in such a way that the same frequency portions as for the standard contribute as much to the sound perception and to the loudness perception of the individual. The correction of $L_{f1I}$- and $L_{f3I}$-portions to the $L_{f1N}$- and $L_{f3N}$-values is obtained by the loudness correction—different $T_{kI}$, $T_{kN}$.

For non-stationary signals, i.e. if the frequency portions of the presented acoustic signal vary in time, the total masking limit FMG which is formed by all the frequency-specific masking-characteristic curve $F_f$ obviously varies also over the whole frequency spectrum, with which the filter 126 or the channel-specific filter, for example, have to be time-variant.

The frequency masking model for the standard is known by E. Zwicker or by ISO/MPEG according to the publications to be supplied below. The corresponding valid individual frequency masking model with $FMG_I$ must first be determined to carry out the necessary corrections, as schematically represented by the demasking filter 126 of FIG. 17.

Furthermore, frequency portions which are masked according to the frequency masking model of the standard are not at all considered in, i.e. not transferred to the hearing device according to the present invention, therefore these frequency portions do not contribute to the loudness.

Along with FIG. 18, it will now be explained how to determine the individual masking model $FMG_I$ of an individual.

Narrow-band noise $R_0$, preferably centralized in relation to its median frequency $f_0$ of a critical frequency band $CB_k$ of the standard, or, if already determined as described before, of the individual, is presented over head phones or, and preferably, over the already loudness-optimized hearing device to the individual. Onto the noise $R_0$, a sine wave is superimposed, preferably at the median frequency $f_0$, as well as above and below of the noise spectrum sine waves at $f_{un}$ and $f_{ob}$. These test sine waves are time-sequentially superimposed. Through the variation of the magnitude of the signals at $f_{un}$, $f_0$ and $f_{ob}$, it is determined when the individual, to which the noise $R_0$ is presented, perceives a change of this noise. The corresponding perception limits, reference by $A_{Wx}$ in FIG. 18, are fixed by three points of the frequency-masking behavior $F_{foI}$ of the individual. Thereby, certain estimations are preferably and initially set to shorten the determination procedure. The masking at the median frequency $f_0$ is estimated to be at −6 dB initially for heavily hearing impaired people. The frequency $f_{un}$ and $f_{ob}$ are displaced by one to three bandwidths in regard to $f_0$. This procedure is preferably performed at least at two to three different median frequencies, distributed over the hearing range of the individual to determine the frequency masking model of the individual in sufficient approximation $FMG_I$, or to determine the parameters of the frequency masking model as $m_{obf}$ and $m_{unf}$, for example.

In FIG. 19, the test arrangement is represented to determine the frequency masking behavior of an individual according to FIG. 18. At a noise generator 128, noise median frequency $f_0$, noise band width B and the average noise power $A_N$ are adjusted. At a superposition unit 130, the output signal of the noise generator 128 is superimposed by the corresponding test signals which are adjusted in a signal generator 132. At the test sine generator 132, magnitude $A_S$ and frequency $f_S$ are adjustable. The test sine generator 132 is, as will be described along with FIG. 20, preferably operated in a pulsed manner, for which it is activated by a cyclic pulse generator 134, for example. Over an amplifier 136, the superimposing signal is fed to the individual over a calibrated head phone or, and preferably, directly over the frequency masking which is yet to be optimized according to FIG. 16.

According to FIG. 20, the noise signals $R_0$ are presented to the individual, for example each second, and the corresponding test sine wave TS is mixed to one of the noise pulses. The individual is asked whether and, if the answer is positive, which one of the noise pulses sounds differently from the others. If all the sound pulses sound to the individual in the same way, the magnitude of the test wave TS is increased as long as the corresponding noise pulse is perceived differently from the others, then the corresponding point $A_w$ is found on the frequency-masking characteristic curve $FMG_I$, according to FIG. 18. From the masking model of the individual, which model is determined in this way, and from the known model of the standard, the demasking model can be determined according to block 126 of FIG. 17.

From FIG. 16, it can be seen that the required masking is actually computed in block 118*a* depending on the presented acoustic signal, and that the filter 124 in the signal transfer path is modified by the masking controller 122 as long as the same result is obtained of the masking of the above and of the individual—model of 118*b*—as it has already been demanded by the guiding masking model of block 118*a*. As mentioned, the loudness transmission generally also changes with the frequency masking correction so that loudness controlling or frequency masking controlling is alternatively performed as long as both criteria are fulfilled by the required precision, only then the acoustic signal which is "quasi momentary" is transformed back into the time domain by the block 114 and transmitted to the individual.

At this stage, it must be noted in addition that it is absolutely possible to estimate at least the frequency masking behavior from the audiogram measurements and/or the loudness scaling according to FIG. 3 instead of the actual measurement of the individual frequency masking behavior. If one starts from approximated estimations for the model identification of the individual, the identification procedure (FIGS. 18 to 20) is substantially shortened.

Loudness-corrected Time Masking

Although the loudness which is perceived by the individual with the hearing device corresponds to the loudness which is perceived by the standard, and, in addition to that, as has been described, the frequency masking behavior of the system "hearing device with individual" is adjusted to the frequency masking behavior of the standard, which is also reached by the afore-described measures, the speech articulation is not yet optimal. This is because the human ear also has a masking behavior in the time domain as further psycho-acoustic perception variable, which masking behavior differs, at the standard, from the time-masking behavior of an individual, for example of a heavily hearing impaired individual.

While the frequency-masking behavior states that, by occurrence of a spectral portion of an acoustic signal with a high level, spectral portions which occur at the same time and which have a low level and a narrow frequency neighborhood of the high-level portions do not contribute to the perceived loudness under certain circumstances, it results from the masking behavior in the time domain that low signals are not perceived after the occurrence of loud acoustic signals, under certain circumstances. Therefore, it is also helpful for the demasking of a heavily hearing impaired person which demasking is performed in the time domain, to speak slowly.

On the analogy of the above-recognized and solved problems regarding the loudness, sound optimization and frequency masking, it is an object for a further increase of the articulation, in that signal sections which are time-demasked for the standard are perceived by the individual, also in a demasked manner, with the aide of a hearing device according to the present invention.

For the consideration or correction of the time-masking behavior of a hearing device as has been described so far, it has to be taken into consideration in general that the procedure which has been described so far is based on the processing of single spectrums. Reciprocal effects of succeeding spectrums are not to be considered. In contrary to that, a causal interdependence is to be established between momentary acoustic signals and future acoustic signals considering the time-masking effects. In other words, a further developed hearing device which also takes into consideration the time-masking behavior is basically equipped by time-variant time delay precautions to consider and to control the influence of the past acoustic signal onto a new signal. From that, it follows that the loudness correction and frequency masking correction, as mentioned for applications to single spectrums, are shifted in time in such a way that input and output spectrums, belonging to them and forming the loudness and frequency masking corrections, continue to be synchronous.

Thereby, it is again valid that a change or a correction of the signal succession in time which is necessary to perform a time-masking correction changes the corresponding momentary loudness, whereby the loudness correction, as already mentioned in connection with the frequency-masking correction, has to be adjusted.

In FIG. 21, starting from the afore-mentioned hearing device structure, especially according to FIG. 16, a modification of this structure is represented under consideration of the time-masking correction. After the time/frequency transformation in the unit 110, the signal spectrums which are obtained sequentially are saved in a spectrum/time buffer 140 (waterfall-spectrum-representation). By way of selection, the spectrum-over-time representation can also be calculated by a Wigner-transformation (see publications 13 and 14). Several sequentially obtained and saved input spectrums are processed in the standard loudness calculation apparatus 53'—taking effect on the single spectrums in the frequency domain analogously to the calculation apparatus 53*a* of FIG. 16—, and the $L_N$-time representation is fed to control unit 116*a*.

A spectrum-time buffer 142 which acts on the buffer 140 in a similar way is connected with its output to the input of the frequency/time-reverse transformation unit 114 (Wigner-reverse transformation or Wigner-synthesis).

Analogously, a further calculation unit 53'$_b$ determines the time image of the $L_I$-values which have been determined through the spectrums. This time image is compared with the time image of the $L_N$-values of the controller 116*a*, and, with the comparison result, a multi-channel loudness filter unit 112*a* with controlled time-variant dispersion (phase shifting, time delay) is controlled. In the filter 112*a*, it is therefore reassured that the correction loudness image of the transmission with the loudness image of the individual corresponds to the one of the standard.

The spectrums which are saved in the buffer 140 or 142 and which entirely represent the signals for a given time range, for example from 20 to 100 ms, are fed to time- and frequency-masking model calculators for the standard 118'a and for the individual 118'b, which are each parametrized by the standard and by the individual parameters or by the state vectors $Z_{FM}$ and $Z_{TM}$. Therein, the frequency-masking model $F_N$, as in FIG. 16, and also the time-masking model $T_M$ are implemented. The outputs of the calculators 118'$_a$ and 118'$_b$ act on a masking-controller unit 122*a* of which the latter acts on the multi-channel-demasking filter 124*a* of which, in addition to 124 of FIG. 16, the dispersion is also controllable in a time-variant manner. Over the simulation calculators 118'$_a$, 118'$_b$ and the control unit 122*a*, the filter unit 124*a* is, in relation to the frequency transfer and to the time behavior, controlled in such a way that the frequency- and time-corrected-masked-input-spectral image in time corresponds to the individually simulated (118$_b$) spectrum of the output time-spectral image.

The control of the loudness filter 112*a* and of the masking-correction filter 124*a* are ensued preferably alternately until both corresponding controller 116*a* and 122*a* detect given minimum deviation criteria. Only then, the spectrums in the buffer unit 142 are transformed back to the time domain in a correct sequence in the unit 114 and are transferred to the individual carrying the hearing device.

FIG. 21 shows a hearing device structure for which the loudness correction, the frequency-masking correction and the time-masking correction are ensued at the signals which are converted into the frequency domain.

A technically possibly simpler embodiment, according to FIG. 22, consistently considers any time phenomenons of signals in the time domain and phenomenons of signals relating to the frequency transfer function in the frequency domain. For that, an output of a time-masking correction unit 141 is connected to the input of the time/frequency transformation unit 110 which, according to the explanations given along with FIG. 16, preferably performs a momentary spectral transformation, as represented schematically, or, if need be, also in addition or instead, a time-masking correction unit 141 is connected between the inverse-transformation unit 114 and the output transducer 65, like loud speakers, stimulator, for example a cochlear implant which is stimulated by electrodes.

Between the transformation unit 110 and 114, the signal processing is performed in block 117 corresponding to the processing between 110 and 114 of FIG. 16.

The time-masking correction unit which is referenced by 140 in FIG. 22 is represented in detail in FIG. 23. It comprises a time-loudness model unit 142 with which the course of the loudness in function of the time, preferably as power integral, is pursued of the acoustic input signal. Analogously, the momentary loudness of the signal is determined by a further time-loudness model unit 142 in the time domain before its conversion in the time/frequency transformation unit 110. The courses of the loudness in function of the time of the mentioned input signals and the mentioned output signals are compared in a (simplified) time-loudness controller 144, and, in a filter unit 146, namely substantially of a gain control unit GK, the loudness of the output signal, in function of the time, is adjusted to the one of the input signal.

For the realization of the time-masking correction, the input signal is fed to a time buffer unit 148 for which WSOLA-algorithms according to W. Verhelst, M. Roelands, "An overlap-add technique based on waveform similarity . . . ", ICASSP 93, p. 554–557, 1993, or PSOLA-algorithms according to E. Moulines, F. Charpentier, "Pitch Synchronous Waveform Processing Techniques for Text to Speech Synthesis Using Diphones", Speech Communication Vol. 9 (5/6), p. 453–467, 1990.

In a standard time-masking model unit $\mathbf{150}_N$, the standard time-masking which is yet to be described is simulated at the input signals, the individual time masking is simulated at the output signals of the time buffer unit 148 in the further unit $\mathbf{15O}_I$. The time maskings which are simulated at the input and output signals of the time buffer unit 148 are compared in a time masking control unit 152, and the signal output is controlled in the time buffer unit 148 according to the comparison result using the mentioned, preferably used algorithms, i.e. the transmission over the time buffer 148 with controlled time-variant extension factor or extension delay.

The time-masking behavior of the standard is again known from E. Zwicker. The time-masking behavior of an individual shall be explained along with FIG. 24.

According to FIG. 24, when an acoustic signal $A_1$ is presented to the standard in function of the time t, a second acoustic signal $A_2$ which is presented in succession is perceived only then, when its level lies above the time masking limit $TMG_N$ drawn by a dashed line. The course of this masking limit, at its decrease, is primarily given by the level of the momentary presented acoustic signal. If signals of different loudness follow each other, an envelope TMG is formed of all TMGs which are produced of the signals.

In FIG. 24, the time-masking limit course ZMG of a heavily hearing impaired individual, for example, is represented in graph I for equally presented acoustic signals $A_1$ and $A_2$ which are schematically represented. From this, it can be seen that the second signal $A_2$, in regard to the time, is not perceived by the hearing impaired person in certain circumstances. By a dot-and-dashed line, the standard time-masking masking behavior $TMG_N$ of the course N, by way of example, is again represented in a course according to I. From the difference, it can be seen that it is a fundamental object for a time-masking correction either to delay the second signal $A_2$ at the individual as long (by the hearing device) as its individual time-masking limit is decreased enough, or to amplify the signal $A_2$ in such a way that it also lies above the time-masking limit of the individual.

If the perceived range of the signal $A_2$ in the course N is referenced by L, one obtains for the individual by the afore-mentioned procedure that $A_2$ must be amplified such that, in the best case, the same perceived range L lies above the time-masking limit of the individual.

In any case, as can be concluded from the description of FIGS. 21 to 23, correction engagements have to be performed according to momentary acoustic signal courses, shifted in time, which correction engagements concern further obtained acoustic signals.

The time constant $T_{AN}$ of the time-masking limit $TMG_N$ of the standard is substantially independent of the level or the loudness of the signals which start the time-masking, according to the representation in FIG. 24 of $A_1$. This is also valid as approximation for the heavily hearing impaired person, so that it is mostly sufficient, level-independent, to determine the time constant $T_{AI}$ of the time-masking limit $TMG_I$.

According to FIG. 25, a narrow-band noise signal $R_0$ which is applied and interrupted in a click-free manner is presented to the individual to determine the individual time-masking limit time constant $T_{AI}$. After interruption of the noise signal $R_0$, a test sine signal with a Gauss envelope is presented to the individual after an adjustable break $T_{Paus}$. Through variation of the envelope magnitude and/or the break duration $T_{Paus}$, a point according to $A_{ZM}$ is determined of the individual time-masking limit $TMG_I$. Through further modifications of the break duration and/or the envelope magnitude of the test signal, two or more points are determined of the individual time-masking limit.

This is ensued by, for example, a trial arrangement, as is represented by FIG. 19, whereby a test sine generator 132 is used which outputs a Gauss-enveloped sine wave. The individual is then asked for which values for $T_{Paus}$ and for the magnitude, the test signal can be still perceived after presenting the noise signal.

Here also, the individually masking behavior can be estimated from diagnostic data, which allow a decisive reduction of the time used for the identification of the individual time-masking model $TMG_I$. The time constant $T_{AN}$ and $T_{AI}$, respectively, are the substantial parameters of this model, as mentioned.

Publications

1) E. Zwicker, Psychoakustik, Springer Verlag Berlin, Hochschultext, 1982
2) O. Heller, Hörfeldaudiometrie mit dem Verfahren der Kategorienunterteilung, Psychologische Beiträge 26, 1985
3) A. Leijon, Hearing Aid Gain for Loudness-Density Normalization in Cochlear Hearing Losses with Impaired Frequency Resolution, Ear and Hearing, Vol. 12, No. 4, 1990
4) ANSI, American National Standard Institute, American National Standard Methods for the Calculation of the Articulation Index, Draft WG S3.79; May 1992, V2.1
5) B. R. Glasberg & B. C. J. Moore, Derivation of the auditory filter shapes from notched-noise data, Hearing Research, 47, 1990
6) P. Bonding et al., Estimation of the Critical Bandwidth from Loudness Summation Data, Scandinavian Audiolog, Vol. 7, No. 2, 1978
7) V. Hohmann, Dynamikkompression für Hörgeräte, Psychoakustische Grundlagen und Algorithmen, Dissertation UNI Göttingen, VDI-Verlag, Reihe 17, Nr. 93
8) A. C. Neuman & H. Levitt, The Application of Adaptive Test Strategies to Hearing Aid Selection, Chapter 7 of Acoustical Factors Affecting Hearing Aid Performance, Allyn and Bacon, Needham Heights, 1993
9) ISO/MPEG Normen, ISO/IEC 11172, Aug. 8, 1993
10) PSOLA, E. Moulines, F. Charpentier, Pitch Synchronous Waveform Processing Techniques for Text to Speech Synthesis Using Diphones, Speech Communication Vol. 9 (5/6), p. 453–467, 1990
11) WSOLA, W. Verhelst, M. Roelands, An overlap-add technique based on waveform similarity . . . , ICASSP 93, p. 554–557, 1993
12) Lars Bramslow Nielsen, Objective Scaling of Sound Quality for Normal-Hearing and Hearing-Impaired Listeners, The Acoustics Laboratory, Technical University of Denmark, Report No. 54, 1993
13) B. V. K. Vijaya Kumar, Charles P. Neuman and Keith J. DeVos, Discrete Wigner Synthesis, Signal Processing 11 (1986) 277–304, Elsevier Science Publishers B. V. (North-Holland)
14) Francoise Peyrin and Rémy Prost, A Unified Definition for the Discrete-Time, Discrete-Frequency, and Discrete-Time/Frequency Wigner Distributions, pp. 858, IEEE Transactions on Acoustics, Speech, and Signal Processing, Vol. ASSP-34, No. 4, August 1986

What is claimed is:

1. A method for manufacturing a hearing device which is adapted to an individual comprising:

providing a model modeling a psycho-acoustic perception variable from acoustic signals;

setting said model so that said psycho-acoustic perception variable as modeled is at least substantially equal to said psycho-acoustic perception variable as perceived by a standard individual;

further setting said model so that said psycho-acoustic perception variable as modeled is at least substantially equal to said psycho-acoustic perception variable as perceived by said individual;

providing an adjusting apparatus separate from said hearing device and setting said adjusting apparatus as a function of said setting and of said further setting;

operationally connecting an input of said adjusting apparatus to an output of an input converter of said hearing device; and adjusting a transmission between said output of said input converter and an input of an output converter of said hearing device as a function of an output of said adjusting apparatus, wherein said model is provided at said hearing device, feeding a signal dependent on an output signal of said input converter to said model as set and feeding a signal dependent of an input signal to said output converter of said hearing device to said model as further set.

2. The method of claim 1, further comprising providing at said hearing device said model twice, one with said setting, one with said further setting and feeding signals dependent, from output signals of said models as set and as further set to said adjusting apparatus.

3. A hearing device comprising an input converter;

an output converter;

a signal processing unit interconnected between an output of said input converter and an input of said output converter, said processing unit comprising control inputs;

an adjusting apparatus, one input thereof being operationally connected to the output of said input converter, a further input thereof being operationally connected to the input of said output converter, the output of said adjusting unit being operationally connected to said control inputs.

4. The hearing device of claim 3, further comprising .

a first calculation unit interconnected between said output of said input converter and an input of said adjusting apparatus;

a second calculation unit, an input thereof being operationally connected to said input of said output converter, the output thereof being operationally connected to said further input of said adjusting apparatus.

5. The device of claim 3, wherein said processing unit comprises frequency-selective parallel channels.

6. The device of claim 3, wherein said processing unit comprises frequency-selective parallel channels, the inputs thereof being operationally connected to said output of said input converter, the outputs thereof being operationally connected to an adding unit, the output of said adding unit being operationally connected to said input of said output converter.

7. The device of claim 6, wherein at least a part of said channels comprise non-linear amplification units with control inputs operationally connected to the output of said adjusting apparatus.

8. A method for manufacturing a hearing device which is adapted to an individual, comprising:

manufacturing a hearing device generating a first electric signal dependent from acoustic input signals to said hearing device and generating a second electric signal dependent from an output signal of said hearing device;

providing a model modeling a psycho-acoustic perception variable from signals representing acoustic signals;

setting said model so that said psycho-acoustic perception variable as modeled is at least substantially equal to said psycho-acoustic perception variable as perceived by a standard individual;

Further setting said model so that said psycho-acoustic perception variable as modeled is at least substantially equal to said psycho-acoustic perception variable as perceived by said individual;

Subjecting said first electric signal to said model as set, thereby generating a first model result;

Subjecting said second electric signal to said model as further set thereby generating a second model result;

Adjusting signal transmission between said input and said output signals of said hearing device as a function of said first and second model results.

9. The method of claim 8, providing said model in said hearing device.

10. The method of claim 9, further providing, in said hearing device, said model twice, one with said setting, one with said further setting.

11. The method of claim 8, thereby adjusting said transmission comprising adjusting transmission of frequency-selective parallel channels.

12. The method of claim 11, further comprising the step of adjusting transmission of said channels non-linearly.

13. A method for manufacturing a hearing device which is adapted to an individual comprising:

providing a model modeling a psycho-acoustic perception variable from acoustic signals;

setting said model so that said psycho-acoustic perception variable as modeled is at least substantially equal to said psycho-acoustic perception variable as perceived by a standard individual;

further setting said model so that said psycho-acoustic perception variable as modeled is at least substantially equal to said psycho-acoustic perception variable as perceived by said individual;

providing an adjusting apparatus and setting said adjusting apparatus as a function of said setting and of said further setting;

operationally connecting an input of said adjusting apparatus to an output of an input converter of said hearing device;

operationally connecting another input of said adjusting apparatus to an input of an output converter of said hearing device; and adjusting a transmission between said output of said input converter and an input of an output converter of said hearing device as a function of an output of said adjusting apparatus.

14. The method of claim 13, wherein said adjusting apparatus is separate from said hearing device.

15. The method of claim 13, further providing said model at said hearing device, feeding a signal dependent of an output signal of said input converter to said model as set and feeding a signal dependent of an input signal to said output converter of said hearing device to said model as further set.

16. The method of claim 15, further comprising providing at said hearing device said model twice, one with said setting, one with said further setting and feeding signals dependent from output signals of said models as set and as further set to said adjusting apparatus.

17. The method of claim 13, further comprising providing said transmission by frequency-selective parallel channels and performing said adjusting at said channels.

18. The method of claim 17, further comprising the step of performing said adjusting at said channels non-linearly.

* * * * *

UNITED STATES PATENT AND TRADEMARK OFFICE

CERTIFICATE OF CORRECTION

PATENT NO. : 7,231,055 B2
APPLICATION NO. : 09/999676
DATED : June 12, 2007
INVENTOR(S) : Bohumir Uvacek et al.

It is certified that error appears in the above-identified patent and that said Letters Patent is hereby corrected as shown below:

On the Title page item 56 under the heading "References Cited" U.S. PATENT DOCUMENTS:

Please correct item 56 the 3rd entry as follows:

--5,274,711 A 11/1993 Rutledge et al.--

Column 5, line 5: Please start a new paragraph beginning with the word "Although".

Column 8, line 36: Please delete "L" and insert therefor --$L'_l(A_{ok})$--.

Column 8, line 39: Please delete "$L_I$" and insert therefor --$L_l(A_{ok})$--.

Column 14, line 27: Please delete "unit s" and insert therefor --units--.

Column 15, line 32: Please delete "$_\alpha$IK" and insert therefor --$\alpha_{IK}$--.

Column 15, line 44: Please delete ".." and insert therefor --.--.

Column 16, line 16: Please delete ":" and insert therefor --.--.

Column 20, line 8: Please delete "decrease" and insert therefor --decreased--.

Column 21, line 21: Please delete "$\delta\alpha^K$" and insert therefor --$\delta\alpha_K$--.

UNITED STATES PATENT AND TRADEMARK OFFICE

CERTIFICATE OF CORRECTION

PATENT NO. : 7,231,055 B2
APPLICATION NO. : 09/999676
DATED : June 12, 2007
INVENTOR(S) : Bohumir Uvacek et al.

It is certified that error appears in the above-identified patent and that said Letters Patent is hereby corrected as shown below:

Column 23, line 30: Please delete "$L_{ff1N}$" and insert therefore --$L_{f1N}$--.

Column 23, line 45: Please delete "chzarac-" and insert therefore --charac-"--.

Signed and Sealed this

First Day of April, 2008

JON W. DUDAS
*Director of the United States Patent and Trademark Office*